US009764920B2

(12) United States Patent
Abe et al.

(10) Patent No.: US 9,764,920 B2
(45) Date of Patent: Sep. 19, 2017

(54) SHEET PROCESSING APPARATUS AND IMAGE FORMING APPARATUS, HAVING A BINDING UNIT WITH OPPOSED SURFACES TO NIP AND BIND A SHEET BUNDLE, AND HAVING A DETACHMENT UNIT TO DETACH SUCH BOUND SHEET BUNDLE FROM AT LEAST ONE OF THE SURFACES

(71) Applicant: CANON KABUSHIKI KAISHA, Tokyo (JP)

(72) Inventors: Hideto Abe, Toride (JP); Rikiya Takemasa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/290,838

(22) Filed: May 29, 2014

(65) Prior Publication Data

US 2014/0353900 A1 Dec. 4, 2014

(30) Foreign Application Priority Data

May 31, 2013 (JP) ..... 2013-115584

(51) Int. Cl.
*B65H 37/04* (2006.01)
*B42B 5/00* (2006.01)

(52) U.S. Cl.
CPC ..... *B65H 37/04* (2013.01); *B42B 5/00* (2013.01); *B65H 2301/43828* (2013.01); *B65H 2801/27* (2013.01)

(58) Field of Classification Search
CPC ..... B65H 37/04; B65H 2301/43828; B65H 2801/27
USPC ..... 270/58.08, 58.09, 58.1, 58.11, 58.12, 270/58.13; 399/410
See application file for complete search history.

(56) References Cited

U.S. PATENT DOCUMENTS

| | | | | |
|---|---|---|---|---|
| 8,246,033 | B2 * | 8/2012 | Sato | B42C 1/12 270/58.07 |
| 8,413,979 | B2 | 4/2013 | Sato | |
| 9,090,051 | B2 * | 7/2015 | Takahashi | B31F 5/02 |
| 9,440,478 | B2 | 9/2016 | Takahashi | |
| 2010/0202814 | A1 * | 8/2010 | Nakamura | B65H 37/04 399/408 |
| 2012/0018943 | A1 * | 1/2012 | Shiraishi | B65H 37/04 270/58.08 |
| 2012/0018944 | A1 * | 1/2012 | Shiraishi | B42C 1/12 270/58.09 |
| 2013/0043637 | A1 * | 2/2013 | Awano | B42B 5/08 270/58.08 |

(Continued)

FOREIGN PATENT DOCUMENTS

| | | | |
|---|---|---|---|
| CN | 1100369A | A | 3/1995 |
| CN | 103373633 | A | 10/2013 |

(Continued)

*Primary Examiner* — Patrick Mackey
(74) *Attorney, Agent, or Firm* — Canon U.S.A., Inc. IP Division

(57) ABSTRACT

A sheet processing apparatus includes a binding unit including a first portion and a second portion and configured to nip a sheet bundle between the first portion and the second portion to deform the sheet bundle in a thickness direction to bind the sheet bundle, and a detachment unit configured to push the bound sheet bundle toward the second portion to detach the bound sheet bundle from the first portion.

34 Claims, 27 Drawing Sheets

(56) References Cited

U.S. PATENT DOCUMENTS

| | | | | |
|---|---|---|---|---|
| 2013/0285303 | A1* | 10/2013 | Awano | B65H 39/00 270/1.01 |
| 2013/0285304 | A1* | 10/2013 | Awano | B65H 39/00 270/58.08 |
| 2014/0003852 | A1 | 1/2014 | Abe | |
| 2014/0077437 | A1* | 3/2014 | Abe | G03G 15/6541 270/58.12 |
| 2014/0239571 | A1* | 8/2014 | Kakutani | G03G 15/5004 270/58.09 |
| 2014/0339754 | A1* | 11/2014 | Abe | B42B 5/00 270/1.01 |

FOREIGN PATENT DOCUMENTS

| | | | |
|---|---|---|---|
| CN | 103625149 | A | 3/2014 |
| JP | 2010-189101 | A | 9/2010 |
| JP | 2010-208854 | A | 9/2010 |
| JP | 2011-184154 | A | 9/2011 |
| JP | 2011-201653 | A | 10/2011 |
| JP | 2013-082167 | A | 5/2013 |
| JP | 05376985 | B2 | 12/2013 |
| JP | 2014-029492 | A | 2/2014 |
| JP | 2015067407 | A | 4/2015 |

* cited by examiner

SHEET PROCESSING APPARATUS AND IMAGE FORMING APPARATUS, HAVING A BINDING UNIT WITH OPPOSED SURFACES TO NIP AND BIND A SHEET BUNDLE, AND HAVING A DETACHMENT UNIT TO DETACH SUCH BOUND SHEET BUNDLE FROM AT LEAST ONE OF THE SURFACES

BACKGROUND OF THE INVENTION

Field of the Invention

The present invention relates to a sheet processing apparatus and an image forming apparatus, and, in particular, to an apparatus configured to bind sheets together without the use of a staple or other external device.

Description of the Related Art

Conventionally, some image forming apparatuses, such as copying machines, laser beam printers, facsimile apparatuses, and multifunction peripherals as combinations thereof, have been provided with a sheet processing apparatus configured to perform binding processing on sheets. Generally, such image forming apparatuses bind a sheet bundle with the use of a metallic staple. Such stapling processing allows a plurality of output sheets to be securely bound at a position specified by a user, and therefore is employed in a large number of sheet processing apparatuses.

However, although the stapling processing using a metallic staple allows the sheet bundle to be bound securely, a special tool should be used to release the sheet bundle once it is bound by this processing. Further, this processing requires work to remove the staple before the stapled sheets are put through a shredder. Similarly, when the stapled sheet bundle is recycled, the staple should also be removed, and the sheets and the staple should be separately collected.

Therefore, apparatuses configured to bind sheets without the use of a staple, especially in consideration of recyclability, are proposed among conventional sheet processing apparatuses. These sheet processing apparatuses, for example, include apparatuses configured to perform binding processing on a sheet bundle by a binding unit including V-shaped upper teeth and inverted V-shaped lower teeth (see Japanese Patent Application Laid-Open Nos. 2010-189101 and 2011-201653).

According to these sheet processing apparatuses, after sheets are bundled together and aligned to one another, the lower teeth and the upper teeth of the binding unit are engaged with each other to form an uneven surface on a part of the sheet bundle in a thickness direction to cause respective fibers of the stacked sheets in the sheet bundle to be entangled with one another, thereby binding the sheet bundle. In other words, these sheet processing apparatuses are configured to bind fibrous sheets without the use of a staple. Hereinafter, a term "staple-free binding" will be used to refer to this method of binding a fibrous sheet bundle without the use of a staple.

However, according to these conventional sheet processing apparatuses, an increase in an applied force to fasten the sheets more securely results in the sheet bundle getting stuck to the teeth. The sheet bundle sticking to the teeth produces problems, such as, impeding conveyance of the sheet bundle to be presented to a user for collection or to a next step in the printing process.

SUMMARY OF THE INVENTION

The present invention is directed to a sheet processing apparatus capable of preventing sheets from becoming stuck to teeth when the sheets are bound.

According to an aspect of the present invention, a sheet processing apparatus includes a binding unit including a first portion and a second portion, and configured to nip a sheet bundle between the first portion and the second portion to deform the sheet bundle in a thickness direction so as to bind the sheet bundle, and a detachment unit configured to urge the bound sheet bundle toward the second portion to detach the bound sheet bundle from the first portion.

Further features of the present invention will become apparent from the following description of exemplary embodiments with reference to the attached drawings. Each of the exemplary embodiments of the present invention described below can be implemented solely or as a combination of a plurality of the exemplary embodiments or features thereof where necessary or where the combination of elements or features from individual exemplary embodiments in a single exemplary embodiment is beneficial.

DESCRIPTION OF THE EMBODIMENTS

Figure 1:
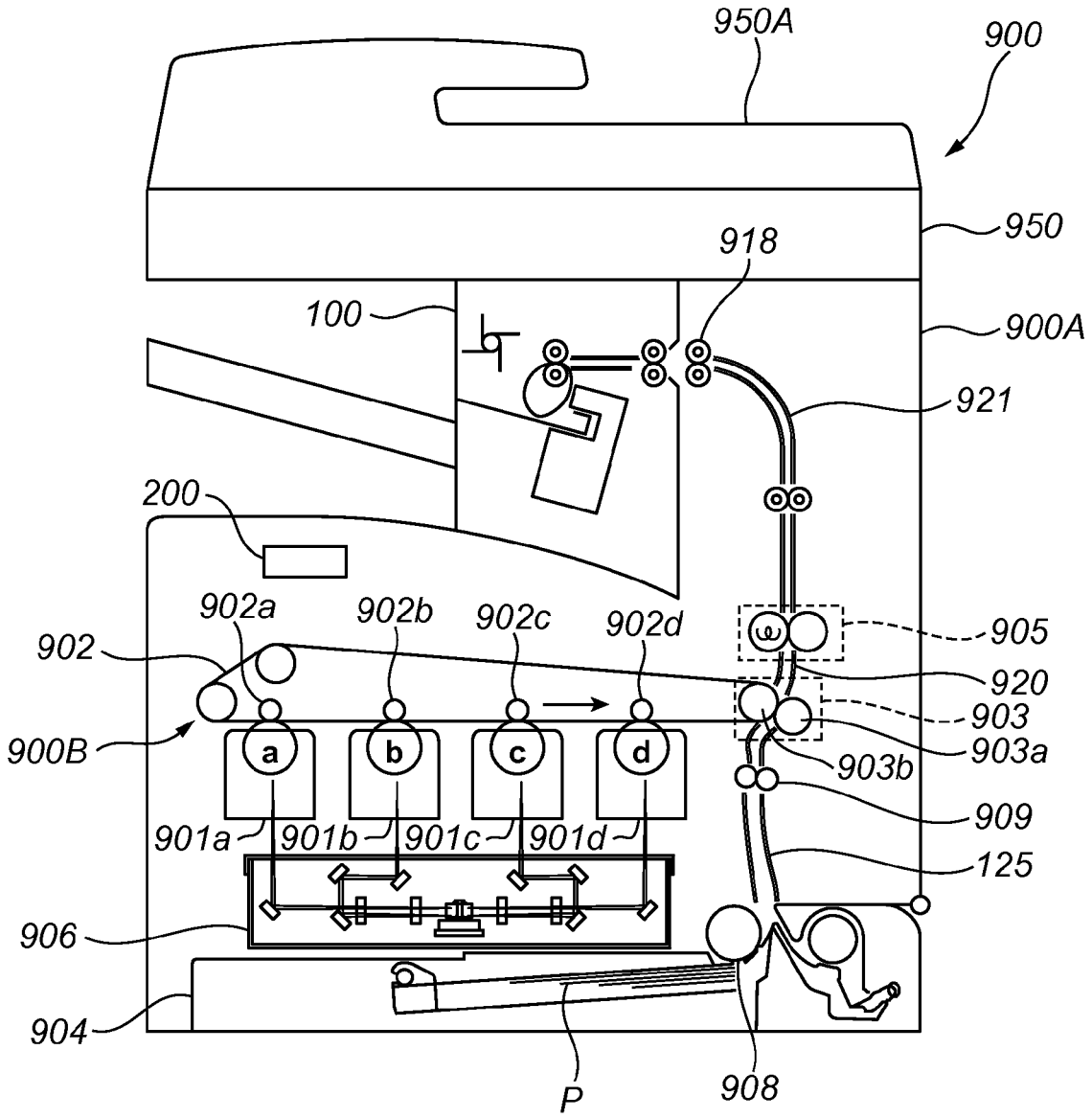
FIG. 1 illustrates a configuration of an image forming apparatus including a sheet processing apparatus according to an exemplary embodiment of the present invention.

In the following description, exemplary embodiments of the present invention will be described in detail with reference to the drawings. FIG. 1 illustrates a configuration of an image forming apparatus including a sheet processing apparatus according to a first exemplary embodiment of the present invention.

Referring to FIG. 1, an image forming apparatus 900 includes an image forming apparatus main body (hereinafter referred to as an apparatus main body) 900A, and an image forming unit 900B configured to form an image on a sheet. An image reading apparatus 950 is disposed above the apparatus main body 900A, and includes a document conveyance device 950A. A finisher 100 is a sheet processing apparatus disposed between a top surface of the apparatus main body 900A and the image reading apparatus 950.

The image forming unit 900B includes photosensitive drums a to d configured to form toner images of four colors, i.e., yellow, magenta, cyan, and black, and an exposure device 906 configured to emit a laser beam based on image information to form an electrostatic latent image on each of the photosensitive drums a to d. Each of these photosensitive drums a to d is driven by a motor (not illustrated). Further, a primary charging device, a developing device, and a transfer charging device (not illustrated) are disposed around each of the photosensitive drums a to d. Each of the photosensitive drums a to d and these devices are unitized as process cartridges 901*a* to 901*d*.

Further, the image forming unit 900B includes an intermediate transfer belt 902 configured to be rotationally driven in a direction indicated by an arrow, a secondary transfer unit 903 configured to transfer a full color image sequentially formed on the intermediate transfer belt 902 onto a sheet P, and the like. Then, transfer biases are applied to this intermediate transfer belt 902 by transfer charging devices 902*a* to 902*d*, which causes the toner images of the respective colors on the photosensitive drums a to d to be sequentially transferred onto the intermediate transfer belt 902 in a multilayered manner. As a result, the full color image is formed on the intermediate transfer belt 902.

The secondary transfer unit 903 includes a secondary transfer counter roller 903*b* supporting the intermediate transfer belt 902, and a secondary transfer roller 903*a* in contact with the secondary transfer counter roller 903*b* via the intermediate transfer belt 902. Referring to FIG. 1, registration rollers 909 and a sheet feeding cassette 904 are provided. A pickup roller 908 feeds and conveys the sheet P contained in the sheet feeding cassette 904. A central processing unit (CPU) circuit unit 200 is a control unit that controls the apparatus main body 900A and the finisher 100.

Next, an image forming operation of the image forming apparatus 900 configured in this manner will be described. Upon a start of the image forming operation, first, the exposure device 906 emits laser light based on image information from a personal computer (not illustrated) or the like, and sequentially exposes the surfaces of the photosensitive drums a to d, which have been evenly charged so as to have predetermined polarities and potentials, thereby forming electrostatic latent images on the photosensitive drums a to d. After that, these electrostatic latent images are developed by toners to be visualized.

For example, first, the exposure device 906 emits laser light based on an image signal corresponding to a yellow component color on a document onto the photosensitive drum a via a polygonal mirror of the exposure device 906 and the like, thereby forming a yellow electrostatic latent image on the photosensitive drum a. Then, this yellow electrostatic latent image is developed by a yellow toner from the developing device, and is visualized as a yellow toner image. After that, this toner image arrives at a primary transfer portion where the photosensitive drum a is in contact with the intermediate transfer belt 902, according to a rotation of the photosensitive drum a. At this time, upon the arrival of the toner image at the first transfer unit in this manner, the yellow toner image on the photosensitive drum a is transferred onto the intermediate transfer belt 902 by a primary transfer bias applied by the transfer charging device 902*a* (a primary transfer).

Subsequently, upon a movement of a portion of the intermediate transfer belt 902 that bears the yellow toner image, a magenta toner image formed on the photosensitive drum b by this time in a similar manner to the above-described method, is transferred onto the intermediate transfer belt 902 from above the yellow toner image. Similarly, as the intermediate transfer belt 902 moves, a cyan toner image, and a black toner image are respectively transferred onto the intermediate transfer belt 902 at respective primary transfer portions while being superimposed onto the yellow toner image and the magenta toner image. As a result, the full color toner image is formed on the intermediate transfer belt 902.

Further, in parallel with this toner image forming operation, the sheet P contained in the sheet feeding cassette 904 is transmitted by the pickup roller 908 one by one. Then, from conveyance guide 125, the sheet P reaches the registration rollers 909, and is conveyed to the secondary transfer unit 903 after being synchronized by the registration rollers 909. After that, the toner images of the four colors on the intermediate transfer belt 902 are collectively transferred onto the sheet P at this secondary transfer unit 903 by a secondary transfer bias applied to the secondary transfer roller 903*a*, which is a transfer unit (a secondary transfer).

Subsequently, the sheet P with the toner images transferred thereon is guided from the secondary transfer unit 903 to a conveyance guide 920, and is conveyed to a fixing unit 905. The sheet P receives heat and a pressure while being transmitted through the fixing unit 905, by which the toner images are fixed onto the sheet P. After that, the sheet P with the images fixed thereon in this manner is transmitted through a discharge passage 921 disposed downstream of the fixing unit 905, and is then discharged by a pair of discharge rollers 918 to be conveyed to the finisher 100.

Figure 2A:
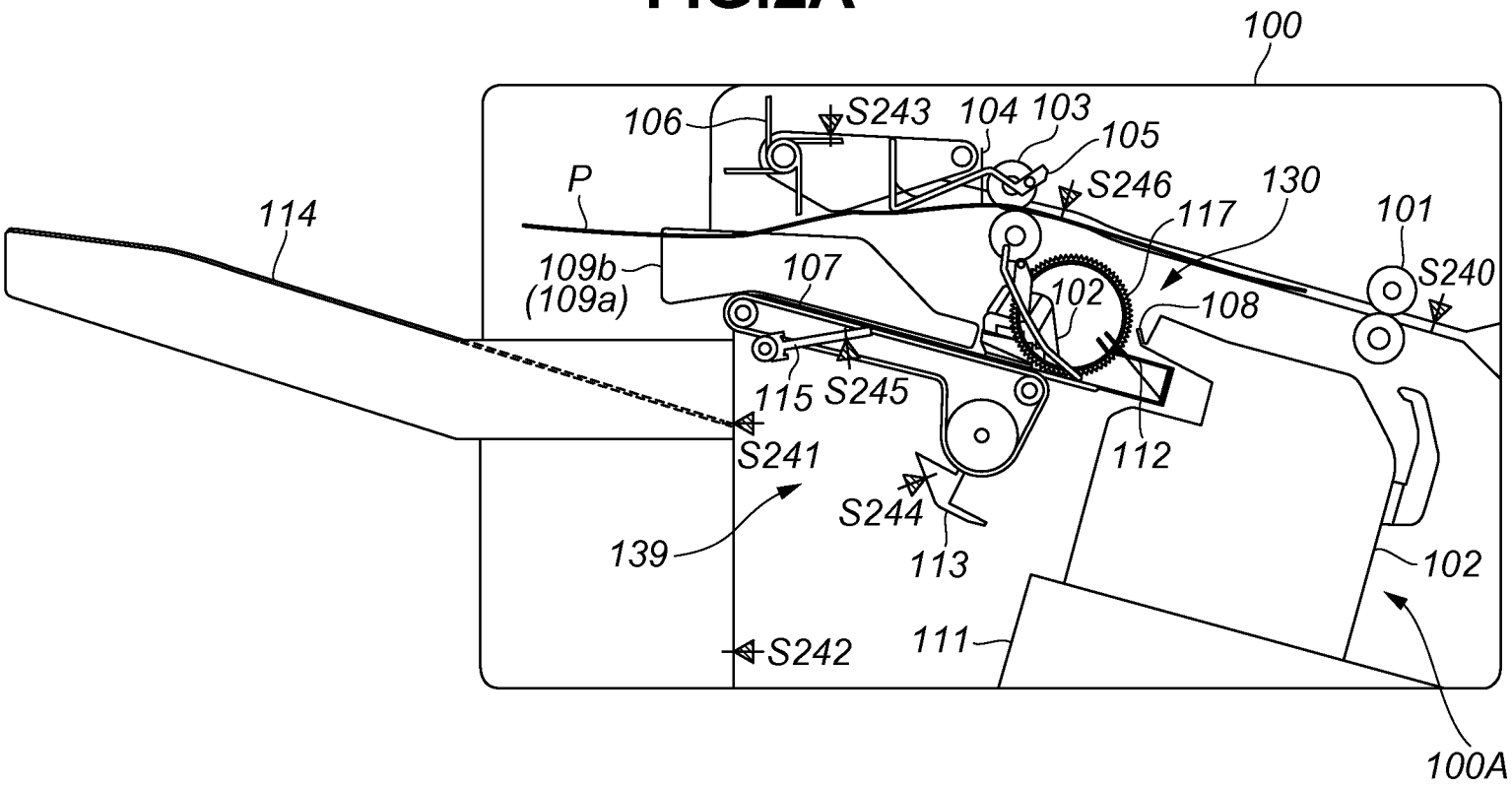
FIGS. 2A and 2B illustrate a finisher that is the sheet processing apparatus.
Figure 2B:
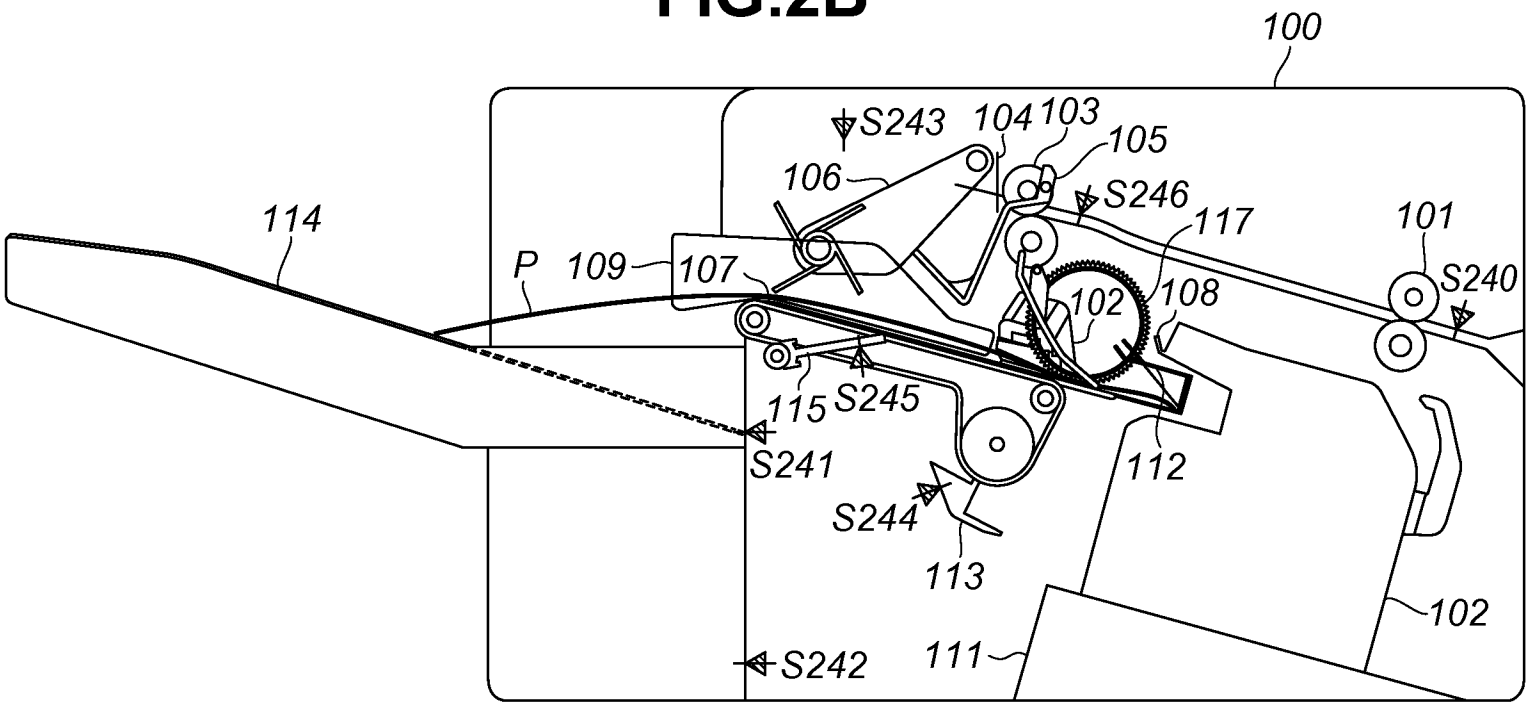

The finisher 100 takes in sheets discharged from the apparatus main body 900A sequentially. The finisher 100 includes a processing unit 139 configured to perform processing of aligning a plurality of received sheets to one another and bundling them into a single bundle, and binding processing of binding the bundled sheet bundle at an upstream edge thereof in a sheet discharge direction (hereinafter referred to as a trailing edge). Further, as illustrated in FIGS. 2A, and 2B, the processing unit 139 of the finisher 100 performs the binding processing as necessary, and also performs processing of discharging the sheets onto a sheet stacking tray 114. This processing unit 139 includes an intermediate processing tray 107 as a sheet stacking unit configured to stack sheets that will be subjected to the binding processing, and a binding processing unit 100A configured to bind the sheets stacked on the intermediate processing tray 107.

Further, front and lateral alignment plates 109*a* and 109*b* are disposed on the intermediate processing tray 107. The front and lateral alignment plates 109*a* and 109*b* regulate (align) the positions of both side edges of the sheet P in a width direction (a lateral direction) after the sheet P is conveyed onto the intermediate processing tray 107 from a direction perpendicular to a lateral direction of the apparatus main body 900A. The front and lateral alignment plates 109*a* and 109*b*, which are a side edge alignment unit configured to align the positions of the side edges of the sheet P loaded on this intermediate processing tray 107 in the width direction, are driven to be moved in the width direction by an alignment motor M253 illustrated in FIG. 7, which will be described below.

Further, normally, these front and lateral alignment plates 109*a* and 109*b* are moved to reception positions where they receive the sheet P by the alignment motor M253 driven based on a detection signal of an alignment home position (HP) sensor (not illustrated). Then, when the front and lateral alignment plates 109*a* and 109*b* regulate the positions of the both side edges of the sheet P loaded on the intermediate processing tray 107, the alignment motor M253 is driven to move the front and lateral alignment plates 109*a* and 109*b* along the width direction into contact with the both side edges of the sheet P loaded on the intermediate processing tray 107.

Further, a pull-in paddle 106 is disposed above a downstream side of the intermediate processing tray 107 in the conveyance direction. Before the sheet P is conveyed into the processing unit 139, a paddle elevating motor M252 is driven based on detection information of a paddle HP sensor S243 illustrated in FIG. 7 that will be described below. With this operation, the pull-in paddle 106 is set into a standby state at an upper position where it does not interfere with the discharged sheet P.

Further, when the sheet P is discharged onto the intermediate processing tray 107, the pull-in paddle 106 is moved downward by driving of the paddle elevating motor M252 in a reverse direction, and is also rotated in a counterclockwise direction by a not-illustrated paddle motor at an appropriate timing. This rotation allows the pull-in paddle 106 to pull in the sheet P and bring the trailing edge of the sheet P into contact with a trailing edge stopper 108. In the present exemplary embodiment, this pull-in paddle 106, the trailing edge stopper 108, and the front and lateral alignment plates 109*a* and 109*b* constitute an alignment unit 130, which aligns the sheet P loaded on the intermediate processing tray 107. For example, if the intermediate processing tray 107 is largely inclined, the sheet P can be brought into contact with the trailing edge stopper 108 without the use of the pull-in paddle 106, and a knurled belt 117 that will be described below.

Referring to FIGS. 2A and 2B, a trailing edge assist 112 is provided. This trailing edge assist 112 is moved from a position where it does not interfere with a movement of a stapler that will be described below to a reception position where it receives the sheet P, by an assist motor M254 driven based on a detection signal of an assist HP sensor S244 illustrated in FIG. 7, which will be described below. Then, this trailing edge assist 112 discharges the sheet bundle to the sheet stacking tray 114 after the binding processing is performed on the sheet bundle, as will be described below.

Further, the finisher 100 includes a pair of inlet rollers 101 for taking the sheet P into the apparatus, and a sheet discharge roller 103. The sheet P discharged from the apparatus main body 900A is transferred to the pair of inlet rollers 101. At this time, the sheet transfer timing is also simultaneously detected by an inlet sensor S240. Then, the sheet P transferred to the pair of inlet rollers 101 is sequentially discharged onto the intermediate processing tray 107 by the sheet discharge roller 103 (i.e., a sheet discharge unit). The sheet P discharged onto the intermediate processing tray 107 is brought into contact with the trailing edge stopper 108 by a return unit such as the pull-in paddle 106 and the knurled belt 117. As a result, the sheets are aligned to one another in the sheet conveyance direction, thereby forming an aligned sheet bundle.

Referring to FIGS. 2A and 2B, a trailing edge drop member 105 is provided. The trailing edge drop member 105 is pushed up by the sheet P passing through the sheet discharge roller 103, as illustrated in FIG. 2A. Once the sheet P has passed through the sheet discharge roller 103, the trailing edge drop member 105 drops due to its own weight to push down the trailing edge of the sheet P from above, as illustrated in FIG. 2B.

Further, a static charge eliminator 104 and a bundle holder 115 are provided. The bundle holder 115 is rotated by a bundle holder motor M255 illustrated in FIG. 7, which will be described below, thereby holding the sheet bundle stacked on the sheet stacking tray 114. Further, a tray lower limit sensor S242, a bundle holder HP sensor S245, and a tray HP sensor S241 are provided. When the sheet bundle prevents light from being transmitted to the tray HP sensor S241, the sheet stacking tray 114 is lowered by a tray elevating motor M251 illustrated in FIG. 7 until the light can be transmitted to the tray HP sensor S241, thereby determining a sheet surface position.

Figure 3A:
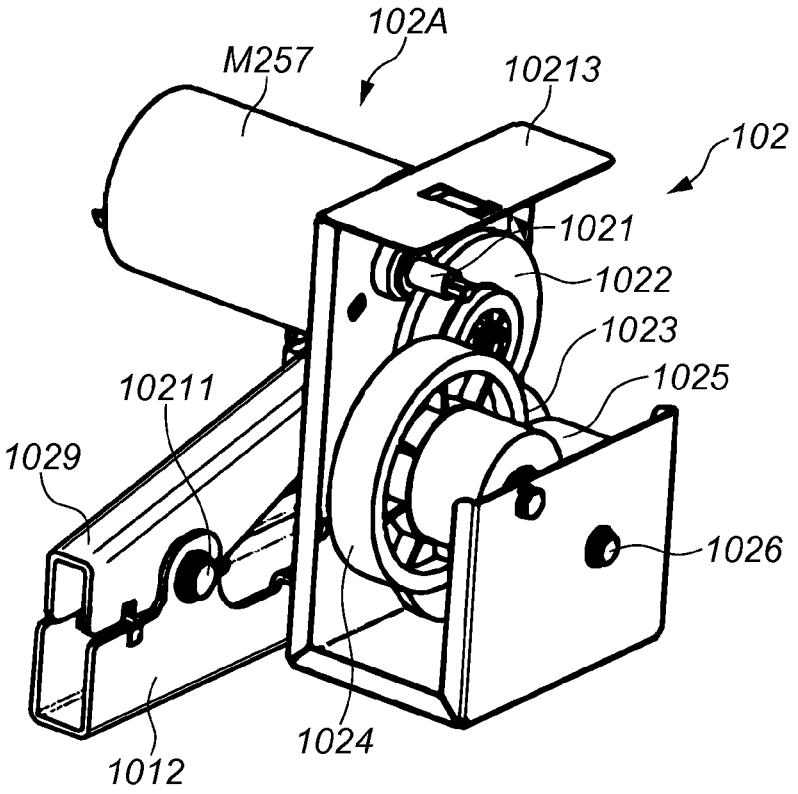
FIGS. 3A and 3B illustrate a configuration of a staple-free binding unit mounted on the finisher.
Figure 3B:
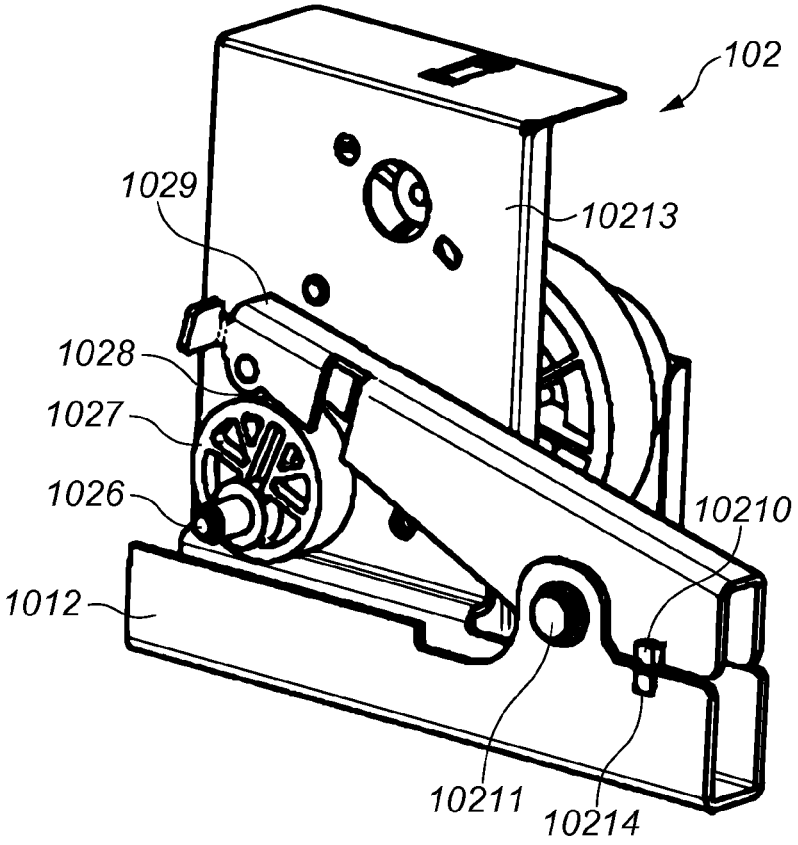

The binding processing unit 100A includes a staple-free binding unit 102, which is a staple-free binding unit. As illustrated in FIG. 3A, the staple-free binding unit 102 includes a staple-free binding motor M257, a gear 1021 configured to be rotated by the staple-free binding motor M257, and step gears 1022 to 1024 configured to be rotated by the gear 1021. Further, the staple-free binding unit 102 resides on a support 111 (FIG. 2A) and includes a gear 1025 configured to be rotated by the step gears 1022 to 1024. Further, the staple-free binding unit 102 includes a lower arm 1012 fixed to a frame 10213, and an upper arm 1029 provided so as to be swingable relative to the lower arm 1012 about an axis 10211 and biased toward the lower arm side by a biasing member (not illustrated). As illustrated in FIG. 3B, lower teeth 10214 as a first portion are provided at the lower arm 1012. Upper teeth 10210 as a second portion are provided at the upper arm 1029.

The gear 1025 is attached to a rotational shaft 1026. Then, as illustrated in FIG. 3B, a cam 1027 is attached to this rotational shaft 1026, and this cam 1027 is disposed between the upper arm 1029 and the lower arm 1012. With this configuration, when the staple-free binding motor M257 is rotated, the rotation of the staple-free binding motor M257 is transmitted to the rotational shaft 1026 via the gear 1021, the step gears 1022 to 1024, and the gear 1025, thereby causing a rotation of the cam 1027.

Referring to FIGS. 3A and 3B, the staple-free binding unit 102 is changed between a binding state in which the staple-free binding unit 102 binds the plurality of sheets by biting them, and a release state in which the staple-free binding unit 102 releases the bite of the sheets. A moving unit 102A is a moving unit that moves the upper teeth 10210 between a binding position where the upper teeth 10210 bind the sheet bundle together with the lower teeth 10214, and an open position where the upper teeth 10210 are separated from the lower teeth 10214. The moving unit 102A includes the staple-free binding motor M257, the cam 1027, the gear 1021, the step gears 1022 to 1024, and the gear 1025. In other words, the moving unit 102A changes the state of the staple-free binding unit 102 between the binding state and the release state.

Figure 4A:
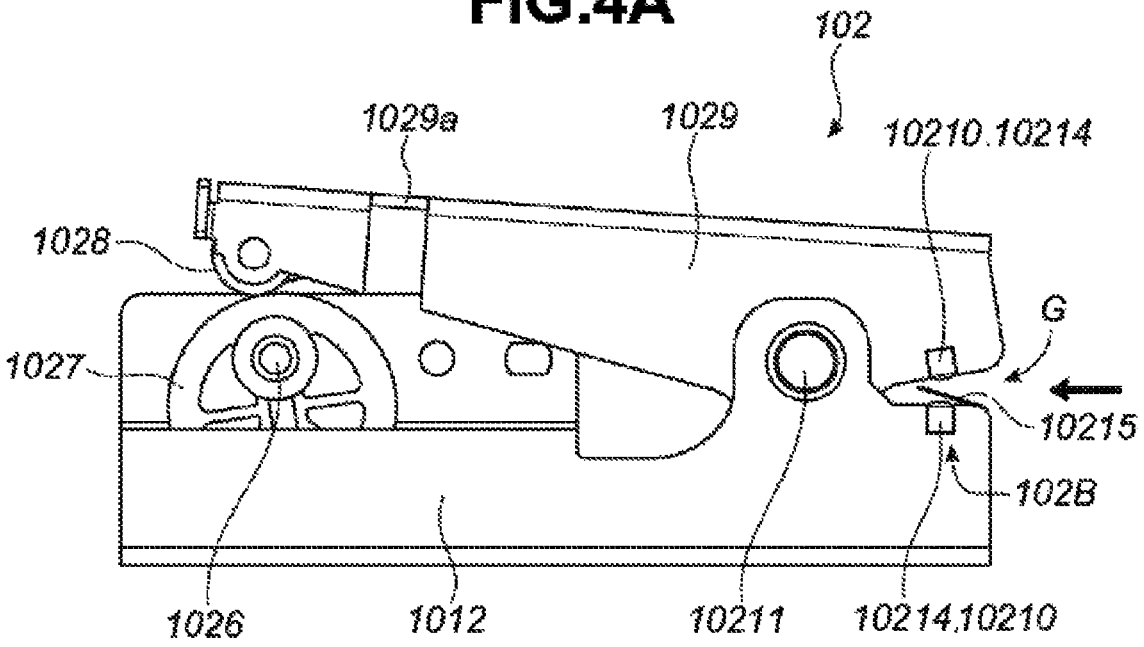
FIGS. 4A and 4B illustrate an operation of the staple-free binding unit.
Figure 4B:
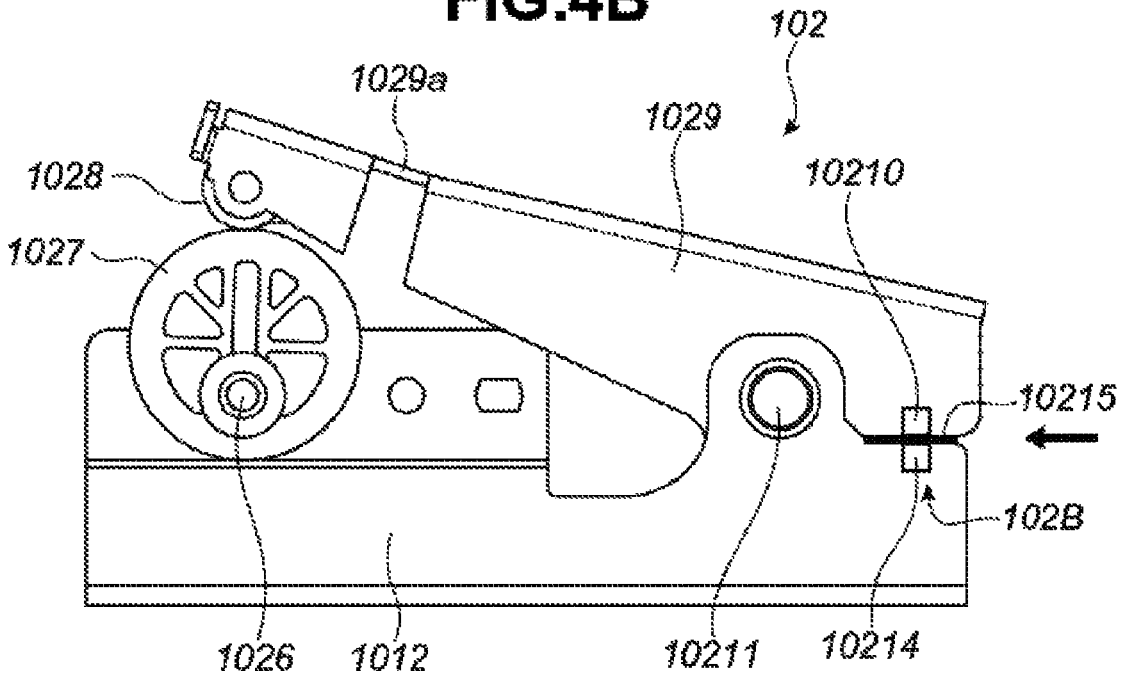

In the present exemplary embodiment, the cam 1027 is in contact with a roller 1028 disposed at one swingable end of the upper arm 1029 from below. As a result, a rotation of the cam 1027 causes the cam-side end of the upper arm 1029, which has been in pressure contact with the cam 1027 via the roller 1028 by a biasing member (not illustrated) until then as illustrated in FIG. 4A, to be raised as illustrated in FIG. 4B.

Figure 5:
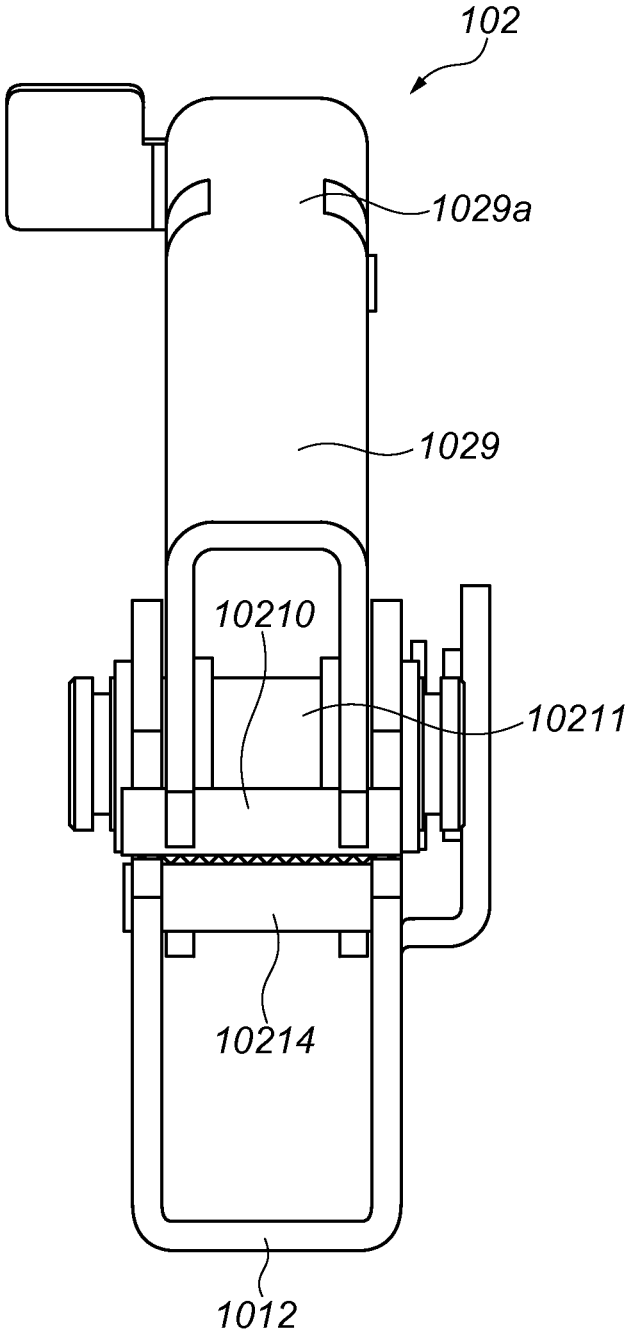
FIG. 5 illustrates shapes of lower teeth and upper teeth of the staple-free binding unit.

On the other hand, the upper teeth 10210, which are a first tooth form, are provided at a bottom of an end of the upper arm 1029 on the opposite side of the cam 1027. The lower teeth 10214, which are a second tooth form, are provided at a top of an end of the lower arm 1012 on the opposite side of the cam 1027. Referring to FIGS. 4A and 4B, a binding unit 102B includes the upper teeth 10210 and the lower teeth 10214 where a plurality of teeth is formed, and binds the plurality of sheets by biting them with the upper teeth 10210 and the lower teeth 10214. Further, FIG. 5 illustrates the staple-free binding unit 102 as viewed from a direction indicated by an arrow in FIG. 4B. The lower teeth 10214 have inverted V shapes (concave portions) as a deformation surface configured to deform the sheet bundle in a thickness direction by contacting the sheet bundle. The upper teeth 10210 have V shapes (convex portions) as the deformation surface configured to deform the sheet bundle in the thickness direction by contacting the sheet bundle. The binding unit 102B sandwiches the sheet bundle between the upper teeth 10210 and the lower teeth 10214 to deform the sheet bundle in the thickness direction, thereby binding the sheet bundle. In other words binding unit 102B nips the sheet bundle between the upper teeth 10210 and the lower teeth 10214 to deform the sheet bundle in the thickness direction, thereby binding the sheet bundle.

When the cam-side end of the upper arm 1029 is moved upward by the cam 1027, the end of the upper arm 1029 opposite to the cam 1027 is moved downward. According to the downward movement of the end of the upper arm 1029 opposite to the cam 1027, the upper teeth 10210 are moved downward to be engaged with the lower teeth 10214, thereby pressing the sheet bundle. Then, when the sheet bundle is pressed in this manner, the sheet P is stretched, so that a fiber on the surface thereof is exposed. Further pressing of the sheet bundle causes the fibers of the sheets to be entangled with one another, thereby fastening the sheets to one another. The upper teeth 10210 and the lower teeth 10214 are a pair of sandwiching members (nipping members) configured to sandwich the sheet bundle to deform it in the thickness direction to thereby bind it.

In other words, when the staple-free binding unit 102 performs the binding processing on the sheets, the upper arm 1029 is swung to cause the upper teeth 10210 on the upper arm 1029 and the lower teeth 10214 on the lower arm 1012 to bite and press the sheets therebetween. The sheets are bitten and pressed by the upper teeth 10210 and the lower teeth 10214, thereby being fastened to one another. At this time, the position of the cam 1027 is detected by a cam sensor S247 illustrated in FIG. 7, which will be described below.

Figure 6:
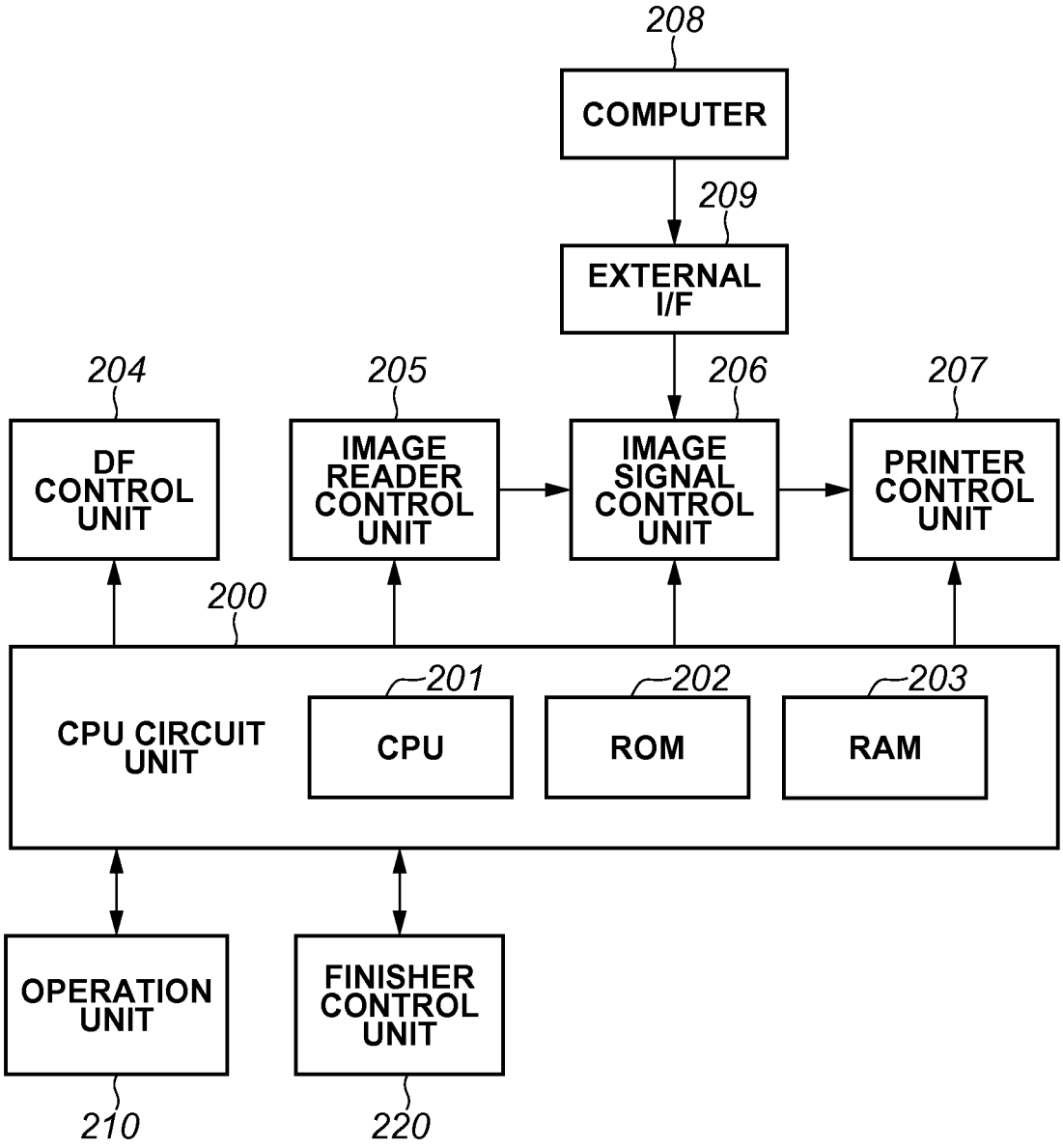
FIG. 6 is a control block diagram of the image forming apparatus.

FIG. 6 is a control block diagram of the image forming apparatus 900. Referring to FIG. 6, the CPU circuit unit 200 is disposed at a predetermined position in the apparatus main body 900A as illustrated in FIG. 1. This CPU circuit unit 200 includes a CPU 201, a read only memory (ROM) 202 storing a control program and the like, and a random access memory (RAM) 203 used as an area for temporarily holding control data and a work area for a calculation required for control.

Further, referring to FIG. 6, an external interface 209 is an interface between the image forming apparatus 900 and an external personal computer (PC) 208. Upon receiving print data from the external PC 208, the external interface 209 rasterizes this data into a bitmap image, and outputs the rasterized data to an image signal control unit 206 as image data.

Then, this image signal control unit 206 outputs this data to a printer control unit 207, and the printer control unit 207 outputs the data received from the image signal control unit 206 to a exposure control unit (not illustrated). An image on a document read by an image sensor (not illustrated) mounted on the image reading apparatus 950 is output from an image reader control unit 205 to the image signal control unit 206, and the image signal control unit 206 outputs this image output to the printer control unit 207.

Further, an operation unit 210 includes a plurality of keys for setting various kinds of functions regarding image formation, a display unit for displaying a setting state, and the like. Then, the operation unit 210 outputs a key signal corresponding to a user's operation performed on each key to the CPU circuit unit 200, and also displays corresponding information on the display unit based on a signal from the CPU circuit unit 200.

The CPU circuit unit 200 controls the image signal control unit 206 and also controls the document conveyance device 950A (refer to FIG. 1) via a document feeder (DF) (i.e., document conveyance device) control unit 204 according to the control program stored in the ROM 202 and the settings of the operation unit 210. Further, the CPU circuit unit 200 controls the image reading apparatus 950 (refer to FIG. 1) via the image reader control unit 205, the image forming unit 900B (refer to FIG. 1) via the printer control unit 207, and the finisher 100 via a finisher control unit 220, respectively.

In the present exemplary embodiment, the finisher control unit 220 is mounted on the finisher 100, and drives and controls the finisher 100 by exchanging information with the CPU circuit unit 200. Alternatively, the finisher control unit 220 may be mounted on the apparatus main body side integrally with the CPU circuit unit 200, and may be configured to directly control the finisher 100 from the apparatus main body side.

Figure 7:
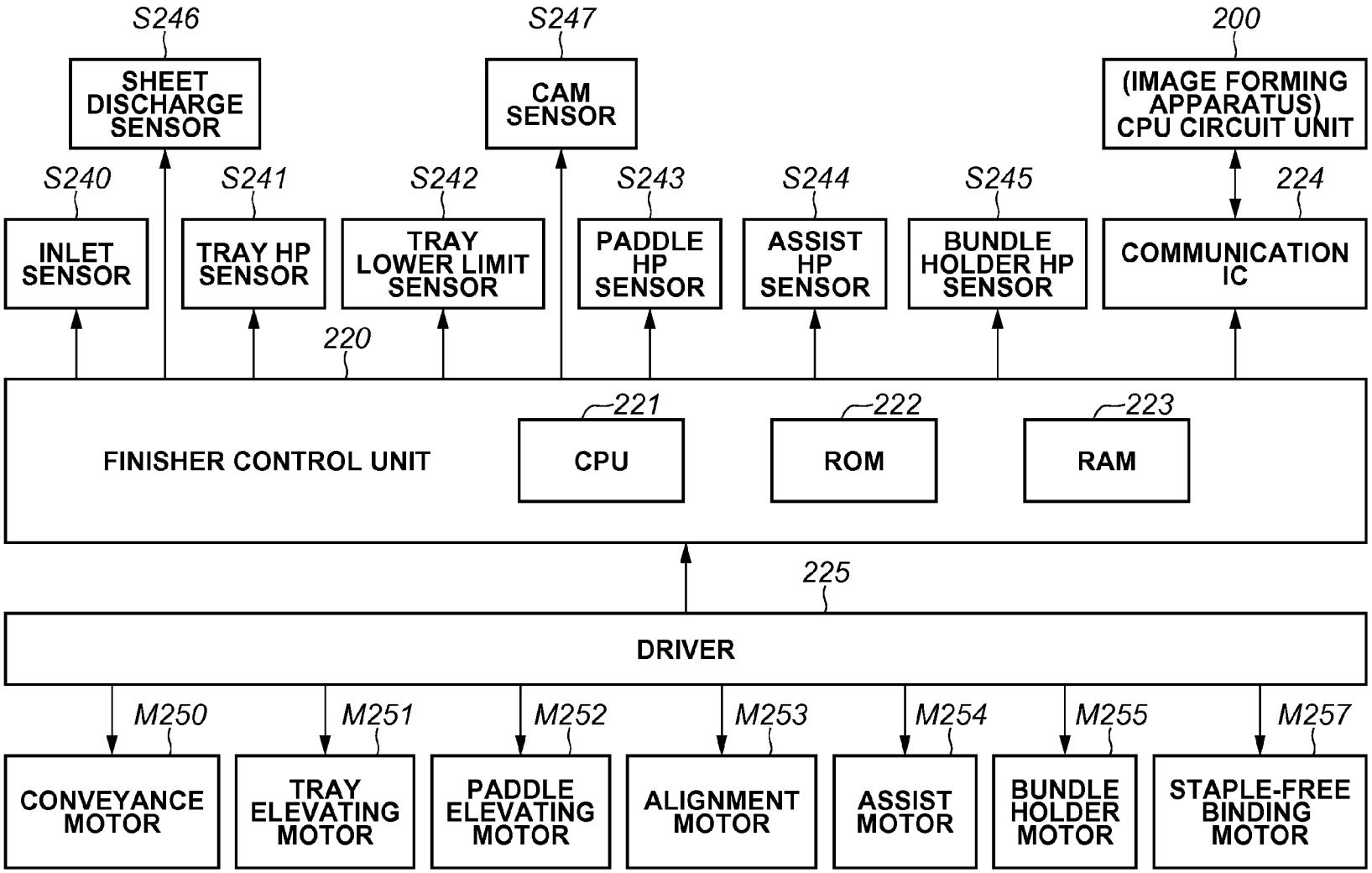
FIG. 7 is a control block diagram of the finisher.

FIG. 7 is a control block diagram of the finisher 100 according to the present exemplary embodiment. The finisher control unit 220 includes a CPU (i.e., a microcomputer) 221, a ROM 222, and a RAM 223. Then, this finisher control unit 220 communicates with the CPU circuit unit 200 via a communication integrated circuit (IC) 224 to exchange data, and drives and controls the finisher 100 by executing various kinds of programs stored in the ROM 222 based on an instruction from the CPU circuit unit 200.

Further, the finisher control unit 220 drives a conveyance motor M250, the tray elevating motor M251, the paddle elevating motor M252, the alignment motor M253, the assist motor M254, the bundle holder motor M255, and the staple-free binding motor M257 via a driver 225.

Further, the inlet sensor S240, a sheet discharge sensor S246, the tray HP sensor S241, the tray lower limit sensor S242, the paddle HP sensor S243, the assist HP sensor S244, and the bundle holder HP sensor S245 are connected to the finisher control unit 220. Further, the cam sensor S247 is connected to the finisher control unit 220. Then, the finisher control unit 220 drives the alignment motor M253, the staple-free binding motor M257, and the like based on detection signals from these respective sensors.

At the time of execution of the staple-free binding on the sheets, first, the finisher control unit 220, which controls an operation of the staple-free binding unit 102, detects the position of the cam 1027 by the cam sensor S247. Then, at the time of reception of the sheets before exertion of the staple-free binding, the finisher control unit 220 controls a rotation of the staple-free binding motor M257 so that the cam 1027 is positioned at a bottom dead center as illustrated in FIG. 4A. When the cam 1027 is positioned at the bottom dead center, a space G is generated between the upper teeth 10210 and the lower teeth 10214, thereby allowing the plurality of sheets to be subjected to the staple-free binding to enter therebetween.

At the time of the exertion of the binding operation, the finisher control unit 220 rotates the staple-free binding motor M257 to swing the upper arm 1029 by the cam 1027 about the axis 10211 in the clockwise direction. Then, when the cam 1027 reaches a top dead center as illustrated in FIG. 4B, the upper teeth 10210 on the upper arm 1029 and the lower teeth 10214 on the lower arm 1012 are engaged with each other. As a result, the sheets are fastened to one another.

If the cam 1027 is further rotated after the cam 1027 has reached the top dead center, the roller 1028 can get over the top dead center of the cam 1027 by a deflection of a deflection portion 1029*a* formed on the upper arm 1029. Then, once the roller 1028 has gotten over the top dead center of the cam 1027 in this manner, the upper arm 1029 is moved in a direction for separating the upper teeth 10210 from the lower teeth 10214. After that, when the cam 1027 is further rotated to reach the bottom dead center again, the cam sensor S247 detects the cam 1027. With this operation, the finisher control unit 220 stops the rotation of the staple-free binding motor M257.

Next, a sheet binding processing operation of the finisher 100 according to the present exemplary embodiment will be described. As illustrated in above-described FIG. 2A, the sheet P discharged from the image forming apparatus 900 is transferred to the pair of inlet rollers 101 driven by the conveyance motor M250. At this time, the leading edge of the sheet P is detected by the inlet sensor S240.

Subsequently, the sheet P transferred to the pair of inlet rollers 101 is transferred from the pair of inlet rollers 101 to the sheet discharge roller 103. The leading edge of the sheet P is discharged onto the intermediate processing tray 107 while static electricity is removed therefrom by the static charge eliminator 104, at the same time as being conveyed while lifting up the trailing edge drop member 105. The sheet P discharged onto the intermediate processing tray 107 by the sheet discharge roller 103 is pushed from above due to the weight of the trailing edge drop member 105, which can reduce a time taken for the trailing edge of the sheet P to drop onto the intermediate processing tray 107.

Subsequently, the finisher control unit 220 controls the inside of the intermediate processing tray 107 based on a signal of the trailing edge of the sheet P, which is detected by the sheet discharge sensor S246. More specifically, as illustrated in above-described FIG. 2B, the finisher control unit 220 lowers the pull-in paddle 106 toward the intermediate processing tray 107 into contact with the sheet P by the paddle elevating motor M252. At this time, the pull-in paddle 106 is rotated in the counterclockwise direction by the conveyance motor M250, whereby the sheet P is conveyed by the pull-in paddle 106 toward the trailing edge stopper 108 in the right direction in FIG. 2B. After that, the trailing edge of the sheet P is transferred to the knurled belt 117. After the trailing edge of the sheet P is transferred to the knurled belt 117, the finisher control unit drives the paddle elevating motor M252 so that the paddle elevating motor M252 moves the pull-in paddle 106 upward. Upon detecting that the pull-in paddle 106 has reached the HP by the paddle HP sensor S243, the finisher control unit 220 stops driving the paddle elevating motor M252.

Figure 8A:
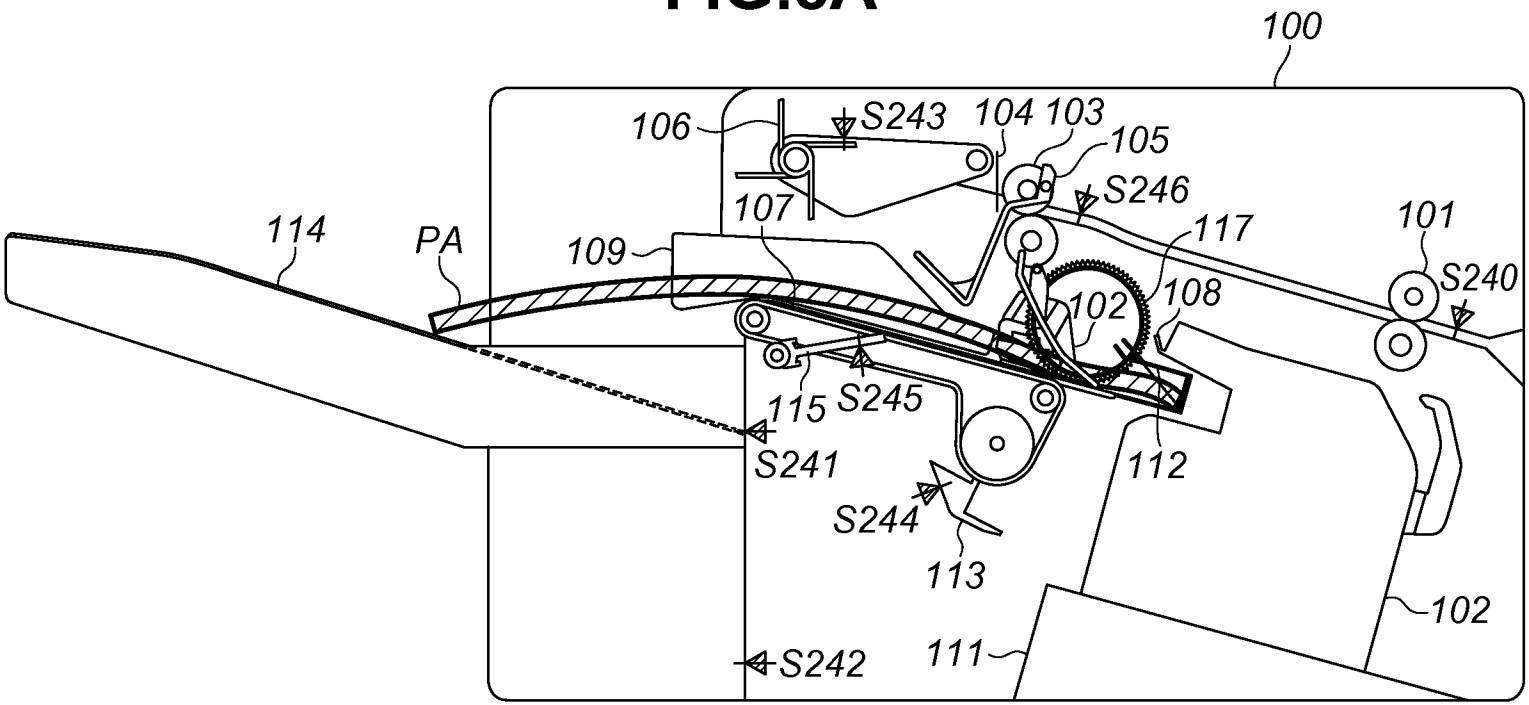
FIGS. 8A, 8B, and 8C illustrate a sheet binding processing operation by the finisher.

After conveying the sheet P conveyed thereto by the pull-in paddle 106 to the trailing edge stopper 108, the knurled belt 117 conveys the sheet P while slipping thereon, thereby constantly biasing the sheet P toward the trailing edge stopper 108. This slipping conveyance can bring the sheet P into contact with the trailing edge stopper 108, thereby correcting a skew of the sheet P. Subsequently, after bringing the sheet P into contact with the trailing edge stopper 108 in this manner, the finisher control unit 220 drives the alignment motor M253 to move the alignment plates 109*a* and 109*b* in the width direction perpendicular to the sheet discharge direction, thereby aligning the position of the sheet P in the width direction. The finisher control unit 220 repeatedly performs this series of operations on a predetermined number of sheets to be subjected to the binding processing, thereby forming a sheet bundle PA aligned on the intermediate processing tray 107 as illustrated in FIG. 8A.

Figure 8B:
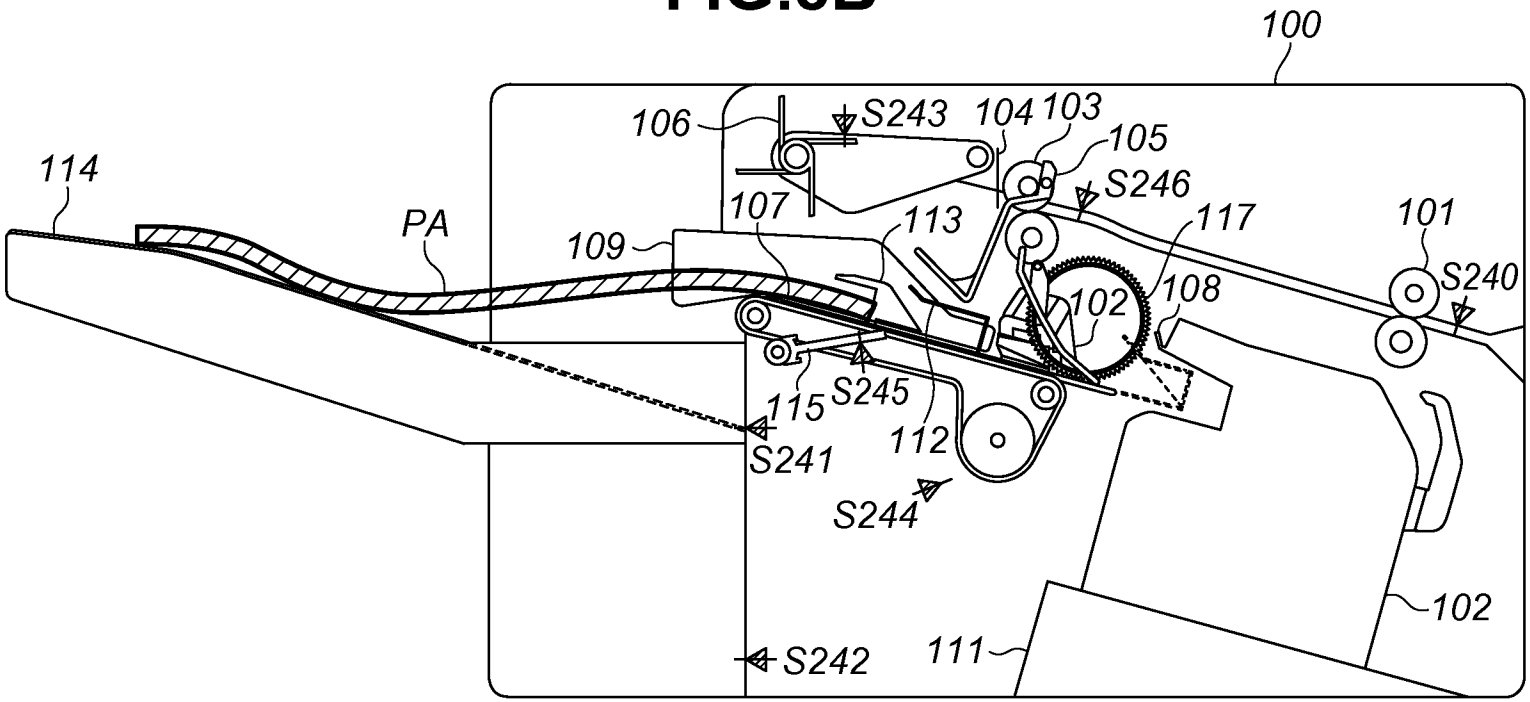

Subsequently, after this alignment operation is performed, the binding unit performs the binding processing if a binding mode is selected. After that, as illustrated in FIG. 8B, the trailing edge of the sheet bundle PA is pushed by the trailing edge assist 112, which is a sheet discharge unit configured to be driven by the assist motor M254, and a discharge claw 113, whereby the sheet bundle PA on the intermediate processing tray 107 is discharged onto the sheet stacking tray 114 as a bundle.

Figure 8C:
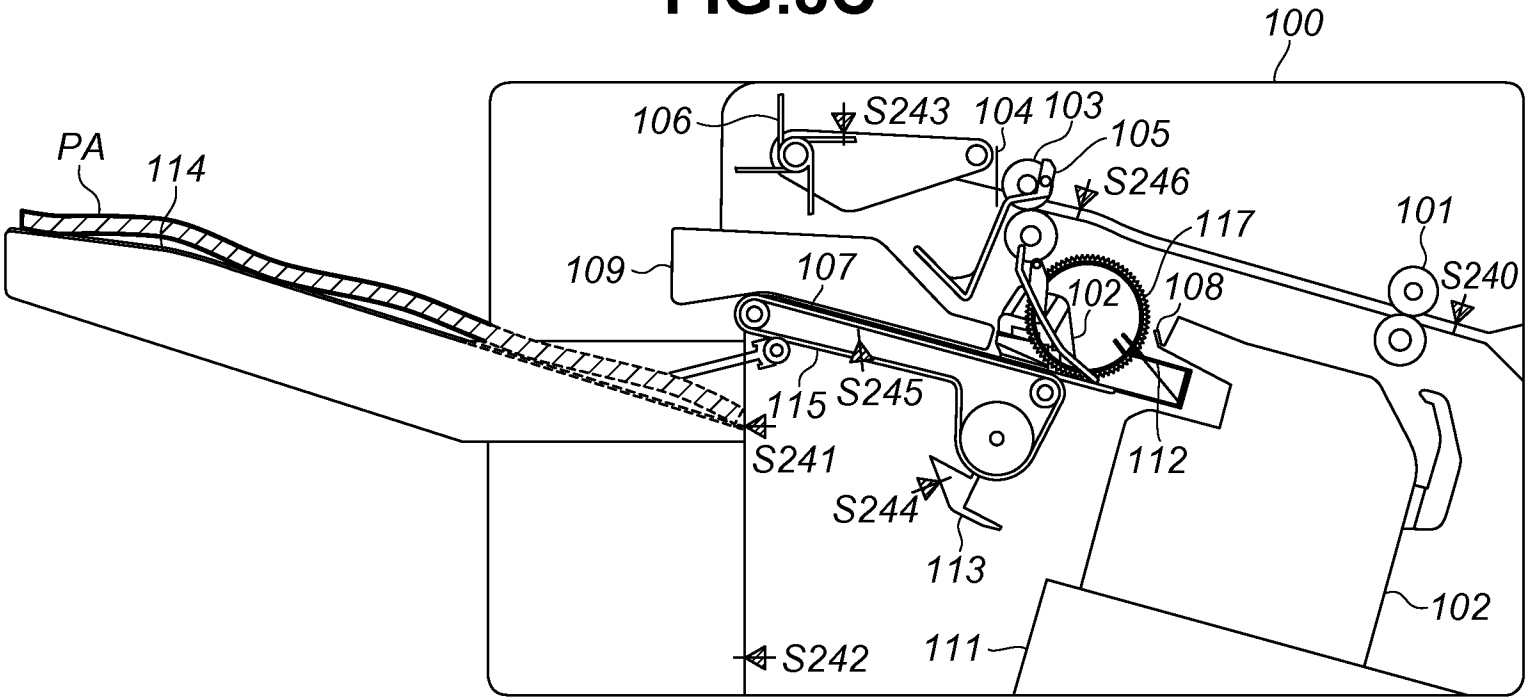

After that, as illustrated in FIG. 8C, the bundle holder 115 is rotated in the counterclockwise direction to hold the trailing edge of the sheet bundle PA to prevent the sheet bundle PA stacked on the sheet stacking tray 114 from being pushing out in the conveyance direction by a subsequently discharged sheet bundle. Then, after completion of the bundle holding operation by this bundle holder 115, if the sheet bundle PA prevents the light from being transmitted to the tray HP sensor S241, the sheet stacking tray 114 is lowered by the tray elevating motor M251 until the light can be transmitted to the tray HP sensor S241, thereby determining the sheet surface position. A required number of sheet bundles PA can be discharged onto the sheet stacking tray 114 by repeatedly performing this series of operations.

If the sheet stacking tray 114 is lowered and starts preventing the light from being transmitted to the tray lower limit sensor S242 during the operation, the finisher control unit 220 notifies the CPU circuit unit 200 of the image forming apparatus 900 of a full load of the sheet stacking tray 114, thereby causing the image forming apparatus 900 to stop the image formation. After that, once the sheet bundles on the sheet stacking tray 114 are removed, the sheet stacking tray 114 is raised until it starts preventing the light from being transmitted to the tray HP sensor S241, and is then lowered to allow the light to be transmitted to the tray HP sensor S241, thereby determining the sheet surface on the sheet stacking tray 114 again. With this operation, the image forming apparatus 900 resumes the image formation.

Figure 9:
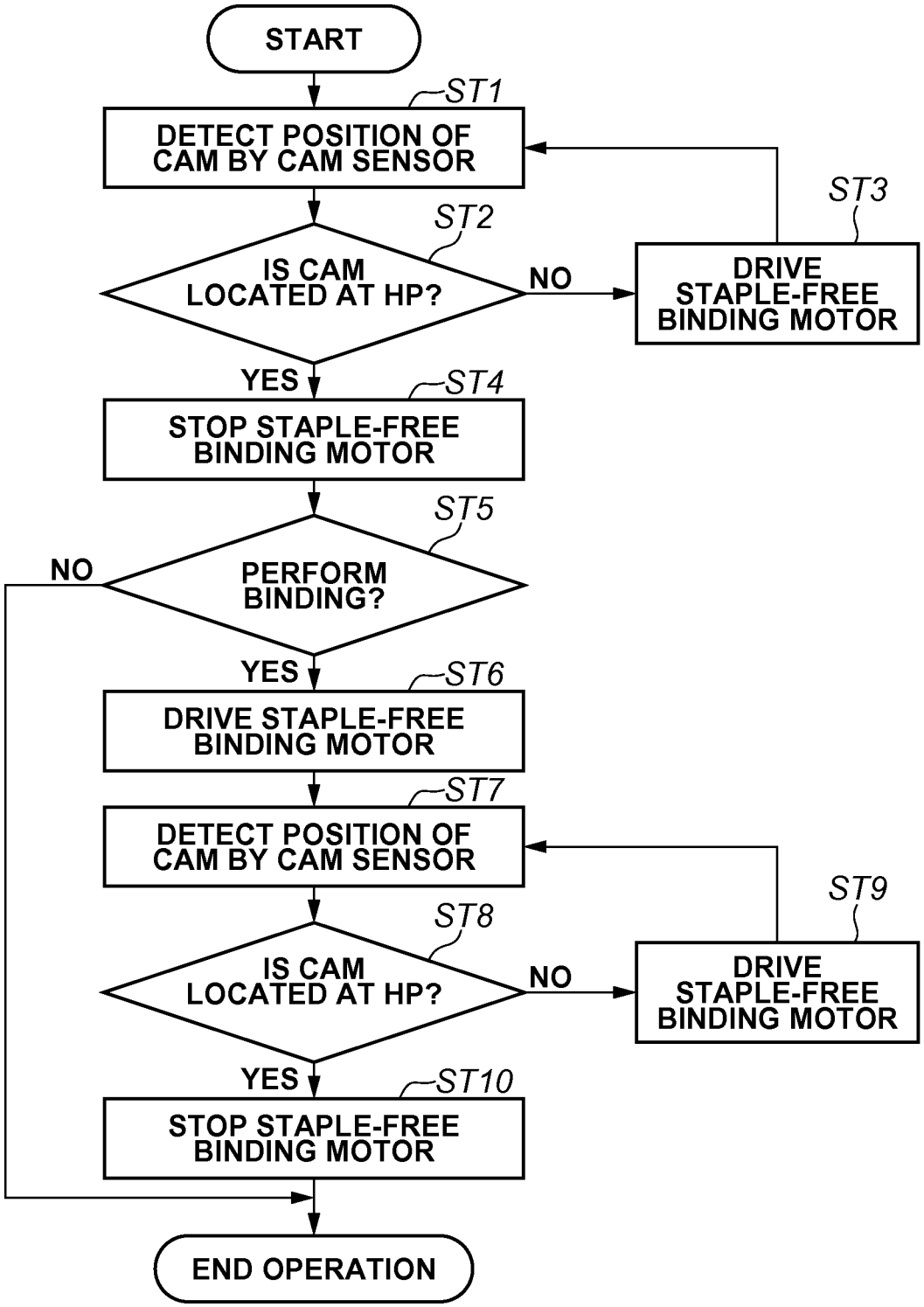
FIG. 9 is a flowchart illustrating control of the staple-free binding operation by a finisher control unit of the finisher.

Next, control of the staple-free binding operation by the finisher control unit 220 during execution of the staple-free binding will be described with reference to a flowchart illustrated in FIG. 9. When performing the staple-free binding on the sheets, first, the finisher control unit 220 drives the staple-free binding motor M257 so as to move the cam 1027 to the home position (HP), which corresponds to the position of the bottom dead center.

Then, in step ST1, the finisher control unit 220 detects the position of the cam 1027 by the cam sensor S247 illustrated in FIG. 7. If the finisher control unit 220 determines that the cam 1027 is not located at the HP (NO in step ST2), in step ST3, the finisher control unit 220 continues driving the staple-free binding motor M257. After that, if the finisher control unit 220 detects that the cam 1027 is located at the HP by the cam sensor S247 (YES in step ST2), in step ST4, the finisher control unit 220 stops the staple-free binding motor M257. As a result, the finisher control unit 220 completes establishing a sheet reception state before performing the staple-free binding.

Subsequently, in step ST5, the finisher control unit 220 determines whether to perform the binding operation. If the finisher control unit 220 determines to perform the staple-free binding (YES in step ST5), in step ST6, the finisher control unit 220 drives the staple-free binding motor M257. As the staple-free binding motor M257 is driven, the upper arm 1029 is swung by the cam 1027 about the axis 10211 in the clockwise direction. When the cam 1027 is further rotated to reach the position illustrated in FIG. 4B, the upper teeth 10210 on the upper arm 1029 and the lower teeth 10214 on the lower arm 1012 are engaged with each other. As a result, the sheet bundle is fastened to one another. After that, when the cam 1027 is further rotated, the upper arm 1029 is swung about the axis 10211 in the counterclockwise direction, so that the upper teeth 10210 are moved in a direction away from the lower teeth 10214.

Subsequently, in step ST7, the finisher control unit 220 detects the position of the cam 1027 by the cam sensor S247. If the finisher control unit 220 determines that the cam 1027 is not located at the HP (NO in step ST8), in step ST9, the finisher control unit 220 continues driving the staple-free binding motor M257. After that, if the finisher control unit 220 determines that the cam 1027 is located at the HP by the cam sensor S247 (YES in step ST8), in step ST10, the finisher control unit 220 stops the staple-free binding motor M257. As a result, the sheet binding operation is completed. On the other hand, if the finisher control unit 220 determines not to perform the binding operation (NO in step ST5), the finisher control unit 220 ends the sheet binding operation immediately.

Figure 10:
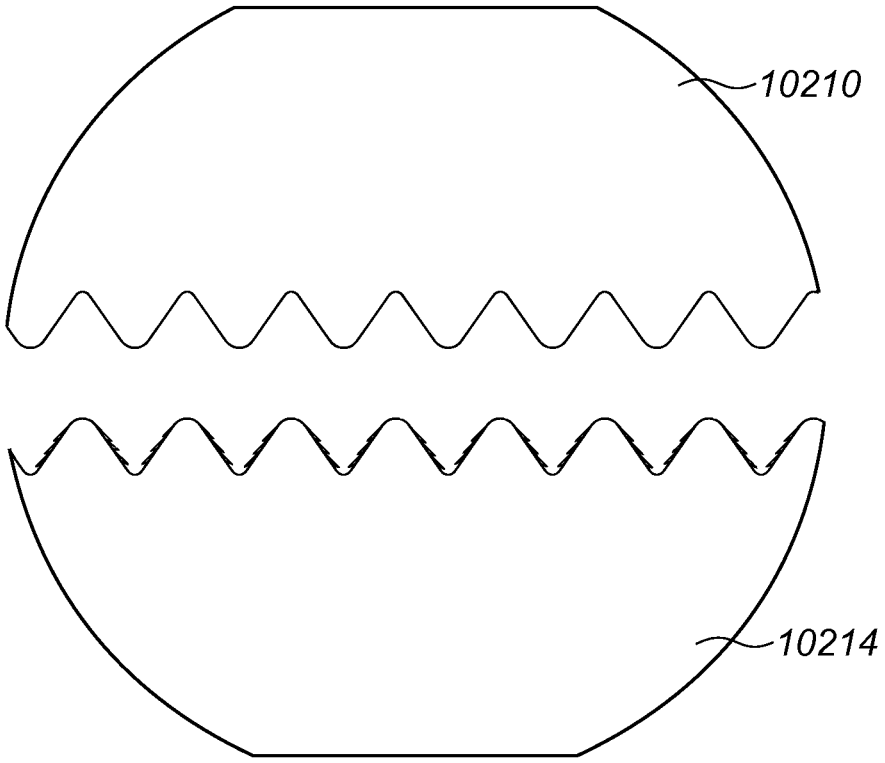
FIG. 10 schematically illustrates states of surfaces of the lower teeth and the upper teeth.

FIG. 10 schematically illustrates the states of the surfaces of the lower teeth 10214 and the upper teeth 10210. The lower teeth 10214 and the upper teeth 10210 include uneven portions (the deformation surfaces for deforming the sheets) on surfaces thereof that contact the sheet bundle, thereby deforming the sheet bundle in the thickness direction. In the present exemplary embodiment, a surface having V shapes is smoothly formed on the upper teeth 10210, while a surface having inverted V shapes is coarsely processed on the lower teeth 10214. In other words, the lower teeth 10214 have a coarser surface than the upper teeth 10210. As a specific processing method therefor, after the upper teeth 10210 and the lower teeth 10214 are shaped by cutting processing, polishing processing is performed on only the upper teeth 10210. As a result, cut traces remain on the lower teeth 10214 to form a coarse surface, while a smooth surface can be formed on the upper teeth 10210.

Then, if the surface of the lower teeth 10214 is coarser than the surface of the upper teeth 10210, the fibers of the fastened sheets are placed into a state of sticking to the lower teeth 10214. In other words, according to the present exemplary embodiment, the sheets can be intentionally stuck to the lower teeth 10214 by roughening the surface of the lower teeth 10214.

Figure 11:
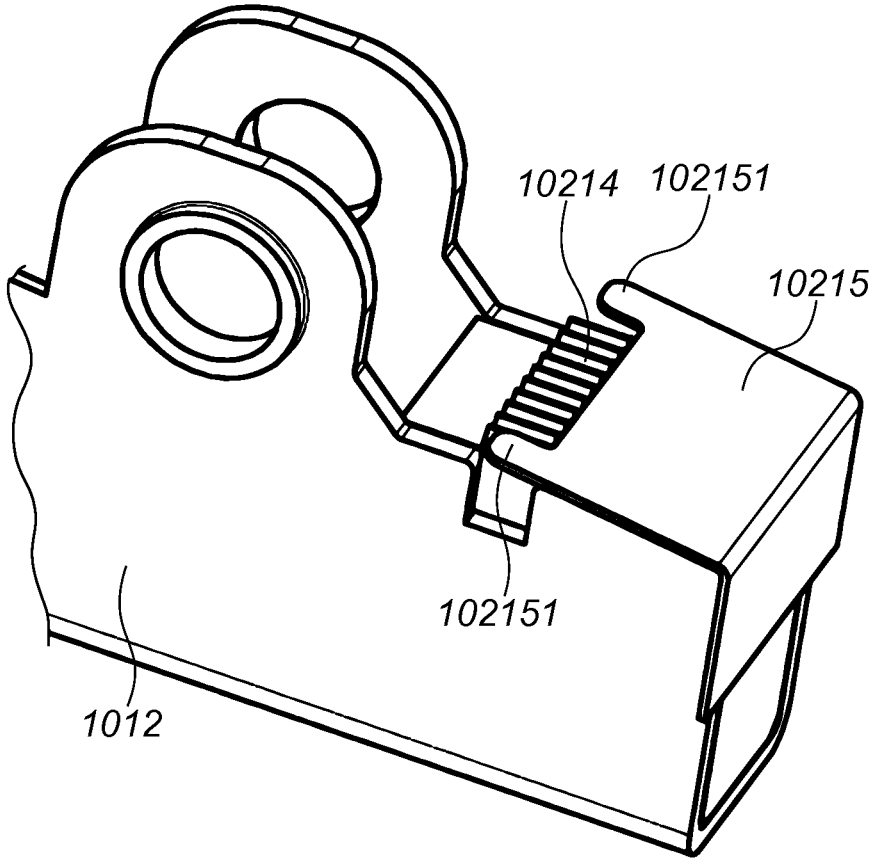
FIG. 11 illustrates a detachment plate spring mounted on the staple-free binding unit.

Further, in the present exemplary embodiment, as illustrated in FIG. 11 and above-described FIGS. 4A and 4B, a detachment plate spring 10215, which is an elastic member, is mounted near the lower teeth 10214 on the lower arm 1012. Then, when the upper arm 1029 is swung in the clockwise direction as described above, the detachment plate spring 10215 is deflected downward by being pressed by the upper arm 1029 via the sheets sandwiched between the upper teeth 10210 and the lower teeth 10214, and is moved to a retracted position where the detachment plate spring 10215 does not interfere with the bite of the sheets. Further, after the sheet bundle is fastened to one another, a movement of the upper arm 1029 causes the detachment plate spring 10215 to be raised elastically.

At this time, the detachment plate spring 10215 is elastically projected upward beyond the teeth of the lower teeth 10214, i.e., in a direction for detaching the sheets beyond the tooth tips of the lower teeth 10214 in the sheet thickness direction. Then, when the detachment plate spring 10215 is raised in this manner, the detachment plate spring 10215 pushes the sheets in the direction away from the lower teeth 10214, thereby detaching the sheets from the lower teeth 10214. Therefore, the detachment plate spring 10215 can prevent the sheets from being stuck to the lower teeth 10214.

Figure 12A:
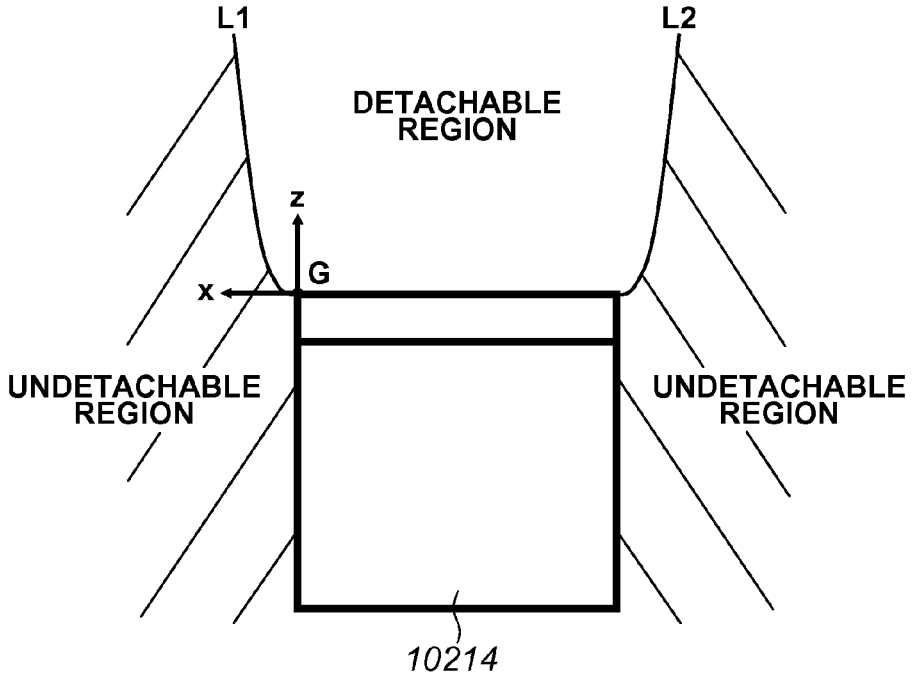
FIGS. 12A and 12B illustrate a detachable region and an undetachable region of the detachment plate spring.
Figure 12B:
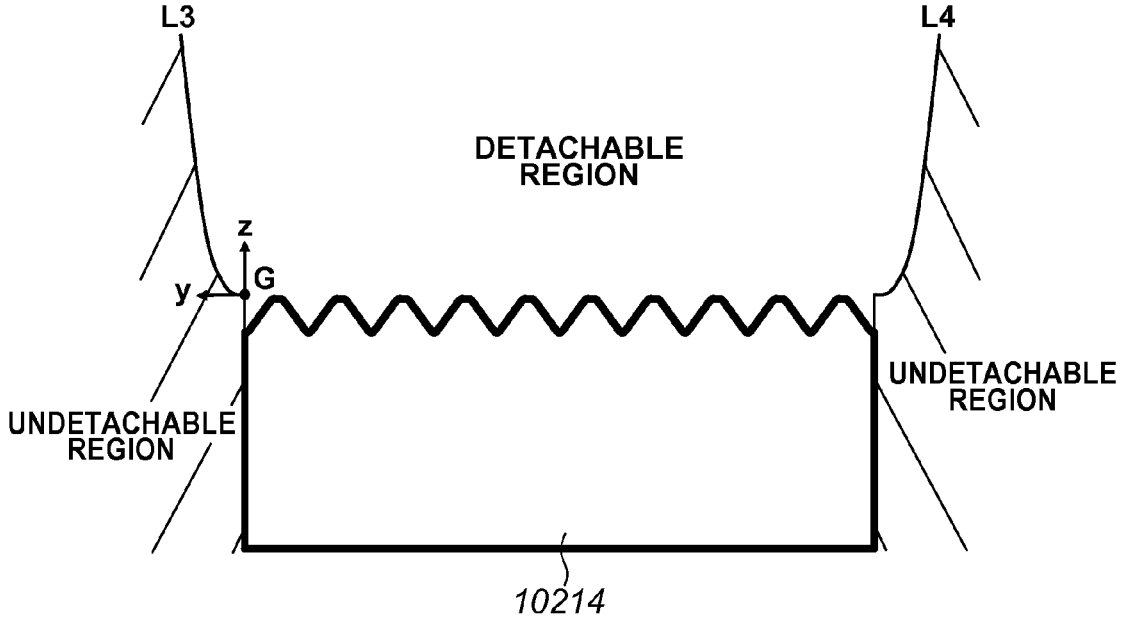

It should be noted here that the detachment plate spring 10215 has to be disposed within a detachable region where the detachment plate spring 10215 can detach the sheets illustrated in FIGS. 12A and 12B, to allow the detachment plate spring 10215, which is a detachment unit, to push and detach the sheets in the direction away from the lower teeth 10214. FIGS. 12A and 12B illustrate the "detachable region" where the sheets can be detached by the detachment plate spring 10215, and an "undetachable region" where the sheets cannot be detached. Then, a tip of the detachment plate spring 10215 should be located within the "detachable region" to realize the detachment of the sheets. FIG. 12A illustrates the lower teeth 10214 as viewed from a longitudinal direction, and FIG. 12B illustrates the lower teeth 10214 as viewed from a direction along a tooth arrangement.

As illustrated in FIG. 12A, as the tip of the detachment plate spring 10215 is being displaced from an origin G in a positive z direction, the detachment plate spring 10215 can lift the stuck sheets more upward, thereby providing an excellent detachment performance. Further, as the tip of the detachment plate spring 10215 is being displaced from the origin G in a positive x direction, the tip of the detachment plate spring 10215 is separated farther away from a fastened portion to cause a larger deformation of the sheets, thereby deteriorating the detachment performance. Then, a curve L1, which is a boundary line between the "detachable region" and the "undetachable region", can be acquired from an equation of a beam deflection according to material mechanics. The following equation is an equation for calculating a deflection (δ) at an end of a cantilevered beam.

$$\delta = WL^3/3EI$$

In this equation, δ represents a deflection amount, W represents a load, L represents a beam length, E represents a Young's modulus, and I represents a moment of inertia of area.

Assuming that the origin G is a fixed point and a distance in the x direction corresponds to the beam length, the deflection amount δ is proportional to the cube of the distance. In other words, an increase in the distance in the x direction leads to a cubed increase in the deflection amount δ of the sheets to be detached. Therefore, the detachment plate spring 10215 should lift up the sheets largely in the positive z direction to detach the sheets. This curve L1 also exists at a symmetric position about the tooth form, and this curve is expressed as a curve L2.

Further, as illustrated in FIG. 12B, the tip of the detachment plate spring 10215 should be located within the "detachable region" in a lateral direction of the lower teeth 10214 (the direction along the arrangement of the lower teeth 10214) to allow the detachment plate spring 10215 to detach the sheets. As the tip of the detachment plate spring 10215 is being displaced from the origin G in the positive z direction, the detachment plate spring 10215 can lift the stuck sheets more upward, thereby providing an excellent detachment performance. Further, as the tip of the detachment plate spring 10215 is being displaced from the origin G in a positive y direction, the tip of the detachment plate spring 10215 is separated farther away from the fastened portion to cause a larger deformation of the sheets, thereby deteriorating the detachment performance. Then, a curve L3, which is a boundary line between the "detachable region" and the "undetachable region", can be acquired from the above-described equation of a beam deflection according to material mechanics. Further, this curve L3 also exists at a symmetric position about the tooth form, and this curve is expressed as a curve L4.

Figure 13A:
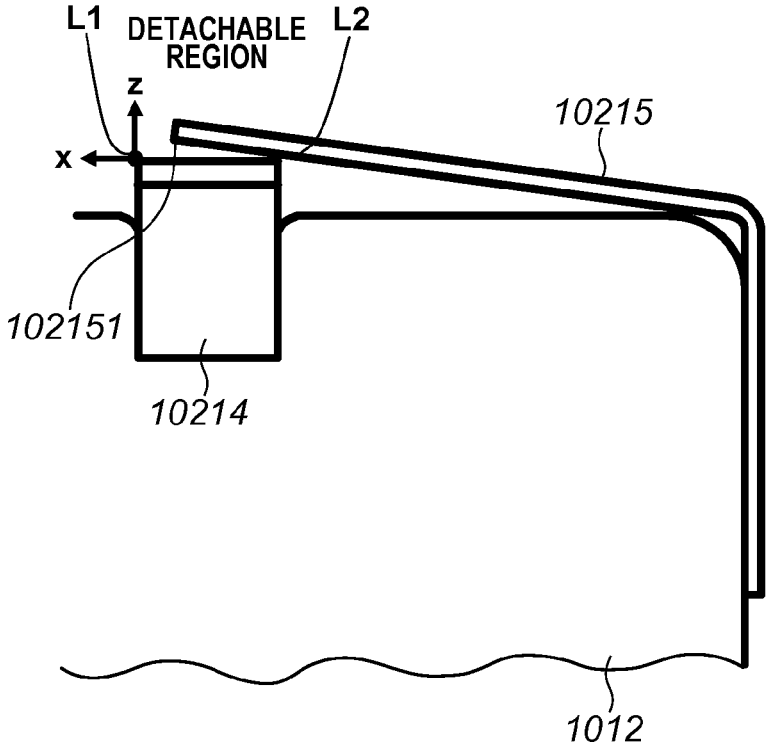
FIGS. 13A and 13B illustrate a positional relationship between the lower teeth and the detachment plate spring.
Figure 13B:
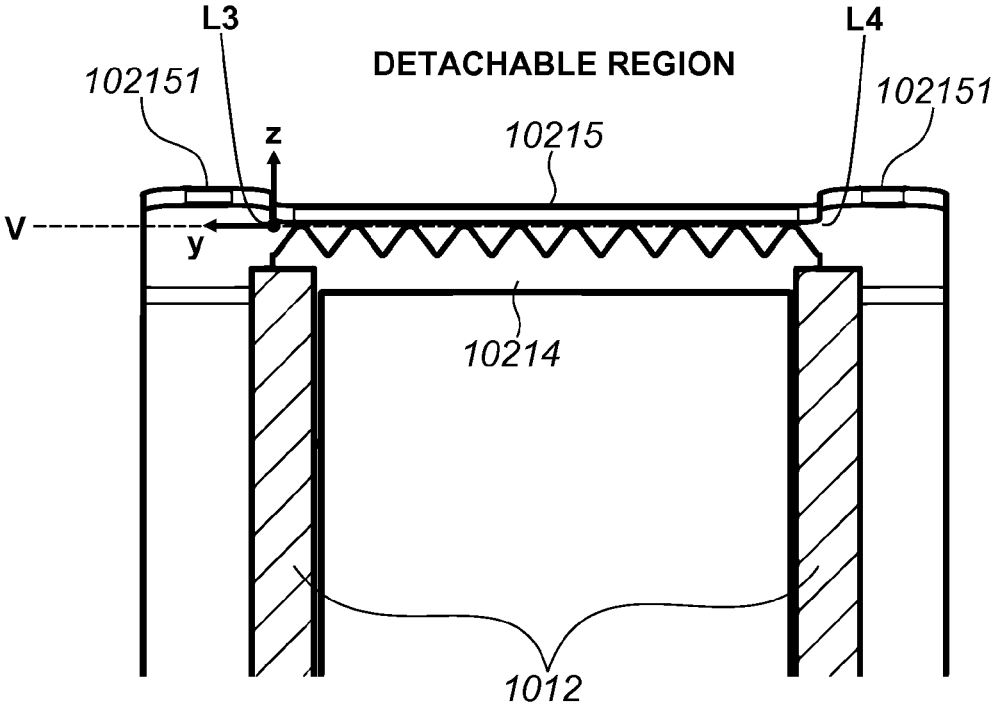

FIGS. 13A and 13B illustrate a positional relationship between the lower teeth 10214 and the detachment plate spring 10215 according to the present exemplary embodiment. As illustrated in FIG. 13A, tip portions 102151 of the detachment plate spring 10215 are located within the "detachable region" illustrated in FIG. 12A. Further, as illustrated in FIG. 13B, the tip portions 102151 (the detachment unit) of the detachment plate spring 10215 are also located within the "detachable region" in the lateral direction. In the present exemplary embodiment, the tip portions 102151 of the detachment plate spring 10215 are located at positions offset from a region where the sheets are fastened to one another, within the "detachable region". As a result, in the present exemplary embodiment, the detachment plate spring 10215 pushes proximate portions outside the region where the sheets are fastened to one another in the direction along the tooth arrangements of the lower teeth 10214 and the upper teeth 10210.

Then, when the binding is not performed, the tip portions 102151 of the detachment plate spring 10215 are located on an upper side relative to a top position V of protrusions of the lower teeth 10214 in the z direction as illustrated in FIG. 13B. Therefore, when the upper arm 1029 is moved after the sheets are fastened to one another, the tip portions 102151 of the detachment plate spring 10215 are located on the upper side relative to the top position V of the protrusions that corresponds to the tips of the lower teeth 10214, and therefore can detach the sheets stuck to the lower teeth 10214.

Figure 14A:
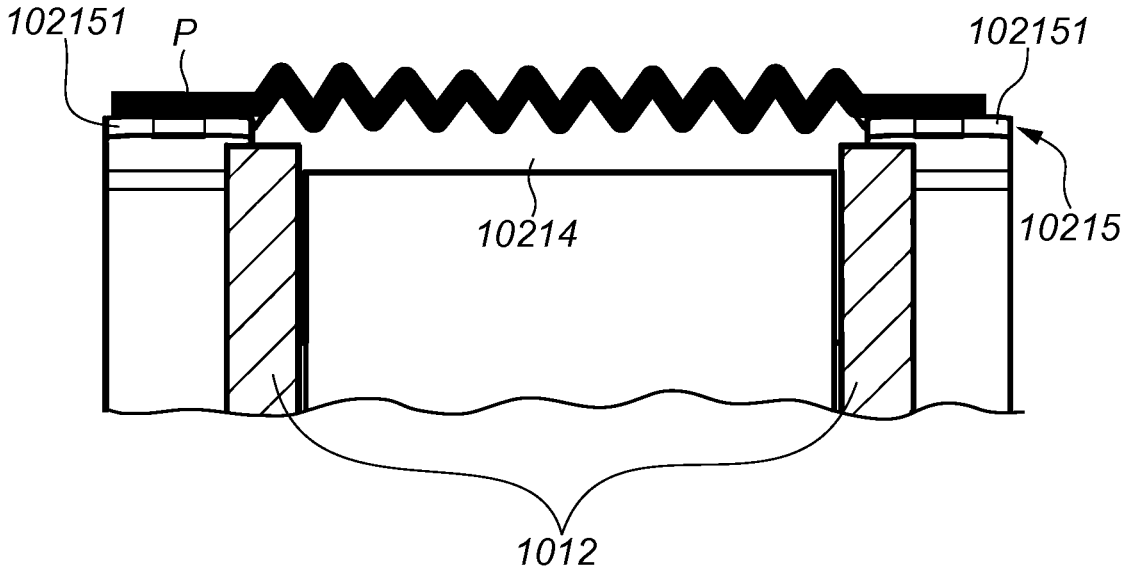
FIGS. 14A and 14B illustrate a state of the detachment plate spring during the staple-free binding operation.
Figure 14B:
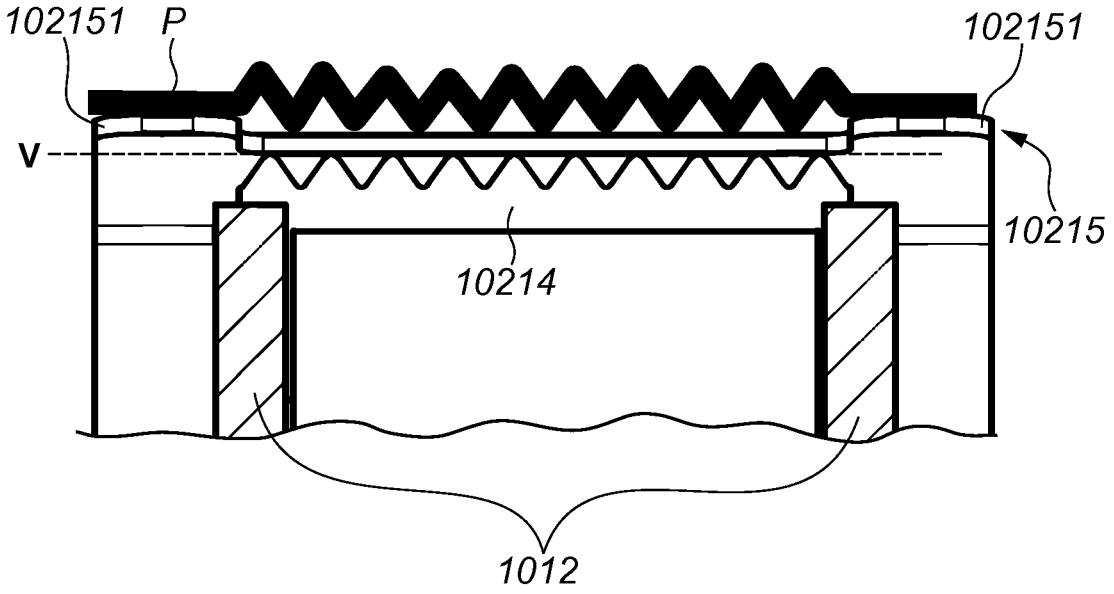

FIG. 14A illustrates the detachment plate spring 10215 with the upper teeth 10210 lowered thereon and the sheet P fastened to the other sheets. At this time, the fiber of the fastened sheet P is placed into a state of sticking to the lower teeth 10214. Further, the tip portions 102151 of the detachment plate spring 10215 are pressed by the upper arm 1029 via the sheet P, i.e., is lowered while being deflected from the position illustrated in above-described FIG. 13B according to the movement of the upper arm 1029. After that, when the upper arm 1029 is moved upward, elastic forces of the tip portions 102151 of the detachment plate spring 10215 are transmitted to the sheet P, thereby detaching the sheet P from the lower teeth 10214 as illustrated in FIG. 14B.

As described above, in the present exemplary embodiment, the detachment plate spring 10215 is provided on the lower arm 1012, and the bound sheets are pushed by the detachment plate spring 10215 in the direction for detaching the sheets from the lower teeth 10214. As a result, even when the sheets are in a state of sufficiently being fastened to one another, the sheet P can be securely detached from the lower teeth 10214 as the first tooth form. Further, the sheets can be detached without moving each of the pair of tooth forms relative to the sheets. In other words, like the present exemplary embodiment, pushing the bound sheets by the detachment plate spring 10215 can prevent the sheets from being stuck to the teeth when the sheets are bound, with the use of a small and simple structure.

In the present exemplary embodiment, the detachment plate spring 10215 is provided on the lower arm 1012. However, if the upper teeth 10210 have a coarser surface, the detachment plate spring 10215 may be provided on the upper arm 1029. In other words, the present exemplary embodiment can be realized by providing the detachment plate spring 10215 on at least one of the lower arm 1012 and the upper arm 1029, and pushing the bound sheets by the detachment plate spring 10215 in a direction for detaching the sheets from at least the one of the upper teeth 10210 and the lower teeth 10214.

In the present exemplary embodiment, the tip portions 102151 of the detachment plate spring 10215 are located at the positions offset from the region where the sheets are fastened to one another. However, the present invention is not limited thereto, and the tip portions of the detachment plate spring 10215 may be located within the region where the sheets are fastened to one another.

Figure 15:
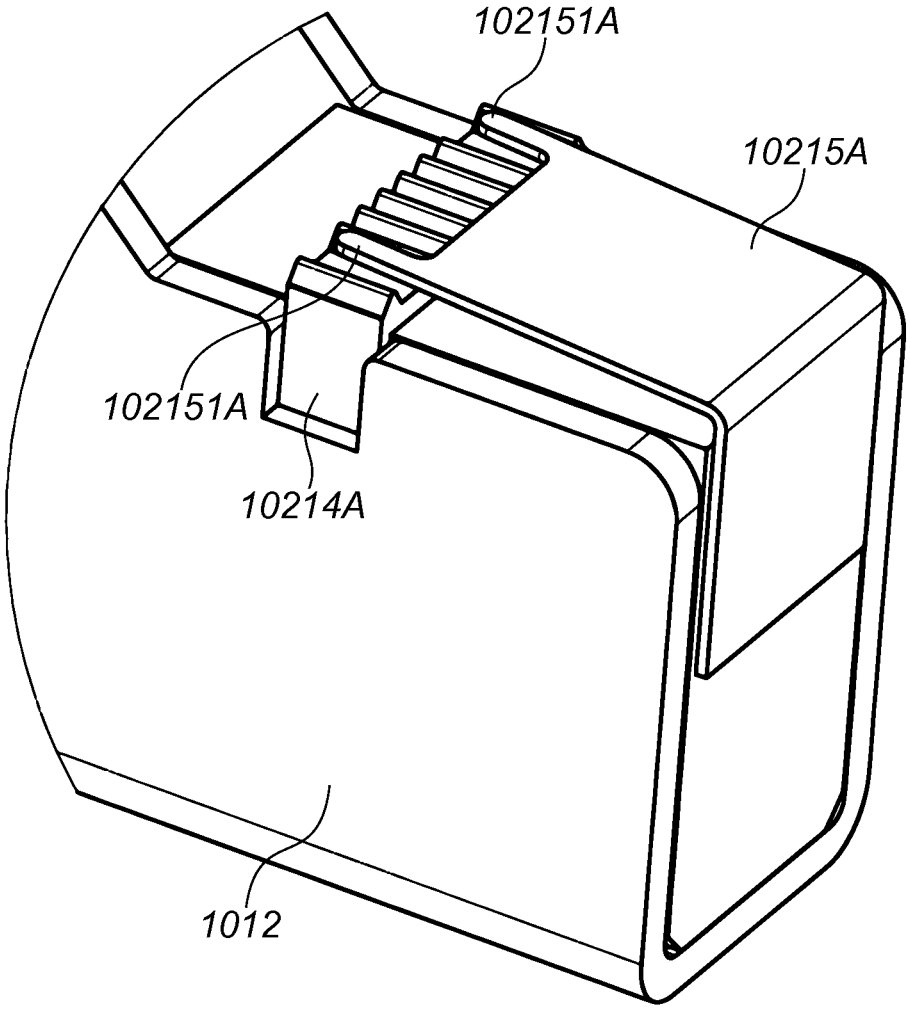
FIG. 15 illustrates a configuration of a staple-free binding unit mounted on a sheet processing apparatus according to a second exemplary embodiment of the present invention.

Next, a second exemplary embodiment of the present invention will be described as an example in which the detachment plate spring is disposed within the region where the sheets are fastened to one another. FIG. 15 illustrates a configuration of a staple-free binding unit mounted on a sheet processing apparatus according to the present exemplary embodiment. In FIG. 15, similar or corresponding portions to those illustrated in above-described FIG. 11 are identified by the same reference numerals as those used in FIG. 11.

Figure 16A:
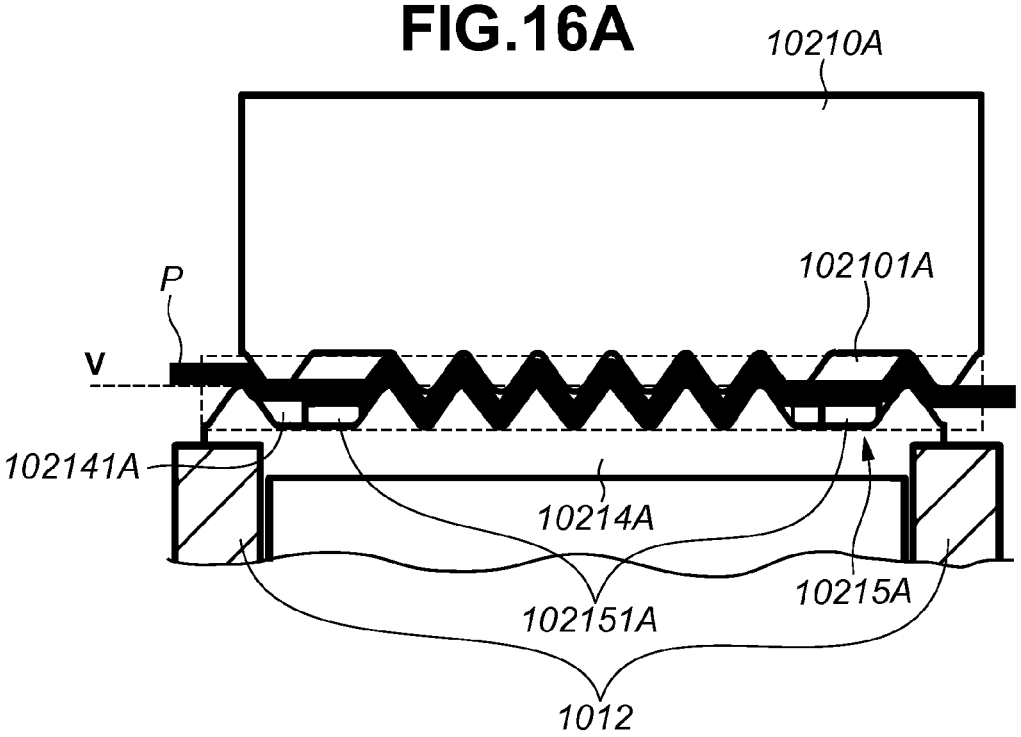
FIGS. 16A and 16B illustrate a state of a detachment plate spring mounted on the staple-free binding unit during the staple-free binding operation.

Referring to FIG. 15, the staple-free binding unit according to the present exemplary embodiment includes a detachment plate spring 10215A and lower teeth 10214A. Inverted V shapes are partially removed from the lower teeth 10214A. As illustrated in FIG. 16A that will be described below, V shapes are partially removed from upper teeth 10210A at portions corresponding to the portions of the lower teeth 10214A where the inverted V shapes are removed. Then, tip portions 102151A of the detachment plate spring 10215A, which is the elastic member, are disposed between inverted V shape removed portions 102141A, which are tooth missing portions of the lower teeth 10214A, and V shape removed portions 102101A of the upper teeth 10210A. In other words, the tip portions 102151A of the detachment plate spring 10215A are respectively disposed between protrusions (the deformation surfaces) of the lower teeth 10214A on both sides, and a plurality of inverted V shapes (the deformation surface) of the lower teeth 10214A at a center thereof. The tip portions 102151A of the detachment plate spring 10215A are respectively disposed between V shapes (the deformation surfaces) of the upper teeth 10210A on both sides, and a plurality of V shapes (the deformation surface) of the upper teeth 10210A at a center thereof.

FIG. 16A illustrates the detachment plate spring 10215A with the upper teeth 10210A lowered thereon and the sheet P fastened to the other sheets. At this time, the fiber of the fastened sheet P is placed into a state of sticking to the lower teeth 10214A, and the tip portions 102151A of the detachment plate spring 10215A are lowered while being deflected by being pressed via the sheet P by the upper teeth 10210A, which are the other tooth form. At this time, the partial removal of the inverted V shapes and the V shapes from the lower teeth 10214A and the upper teeth 10210A allows the tip portions 102151A of the detachment plate spring 10215A to enter inside the "detachable region" as illustrated in FIG. 16B.

Figure 16B:
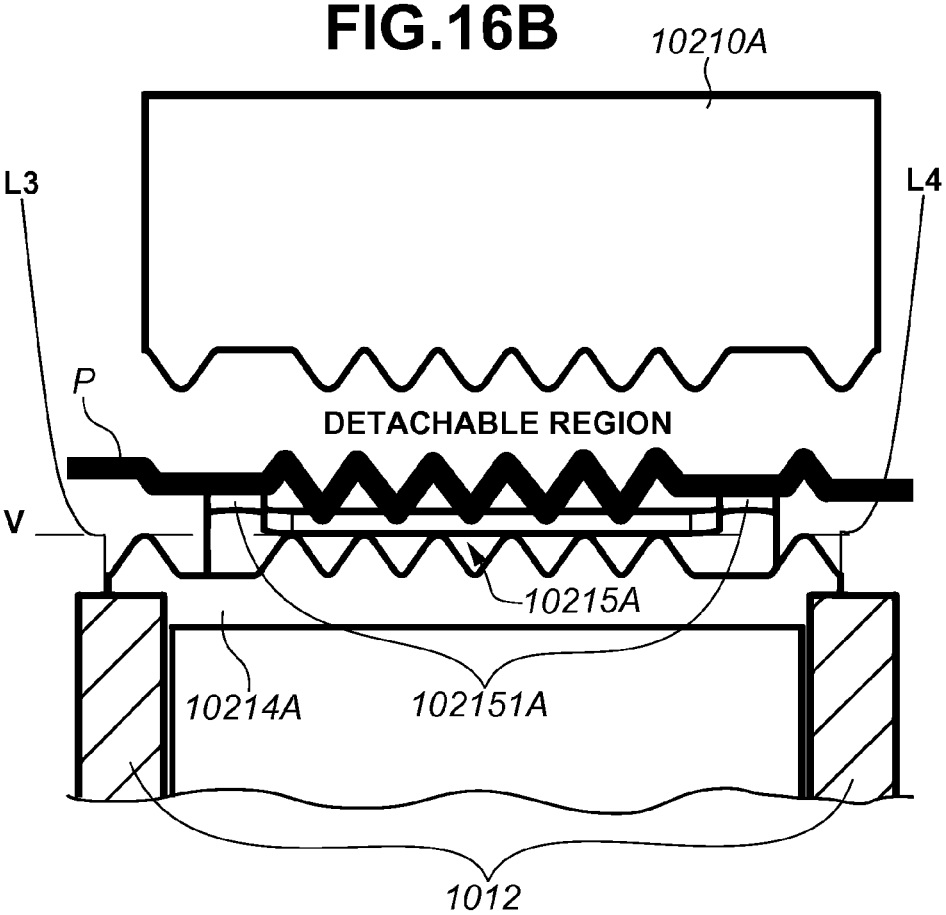

After that, when the upper arm 1029 is moved upward, the tip portions 102151A of the detachment plate spring 10215A are located on an upper side relative to the top position V of protrusions of the lower teeth 10214A in the z direction as illustrated in FIG. 16B. As a result, an elastic force (a restoring force) of the detachment plate spring 10215A is transmitted to the sheet P, and therefore can detach the sheet P stuck to the lower teeth 10214A. In this manner, a similar effect to the above-described first exemplary embodiment can be acquired, even if the detachment plate spring is disposed within the region where the sheets are fastened to one another, like the present exemplary embodiment.

Figure 17:
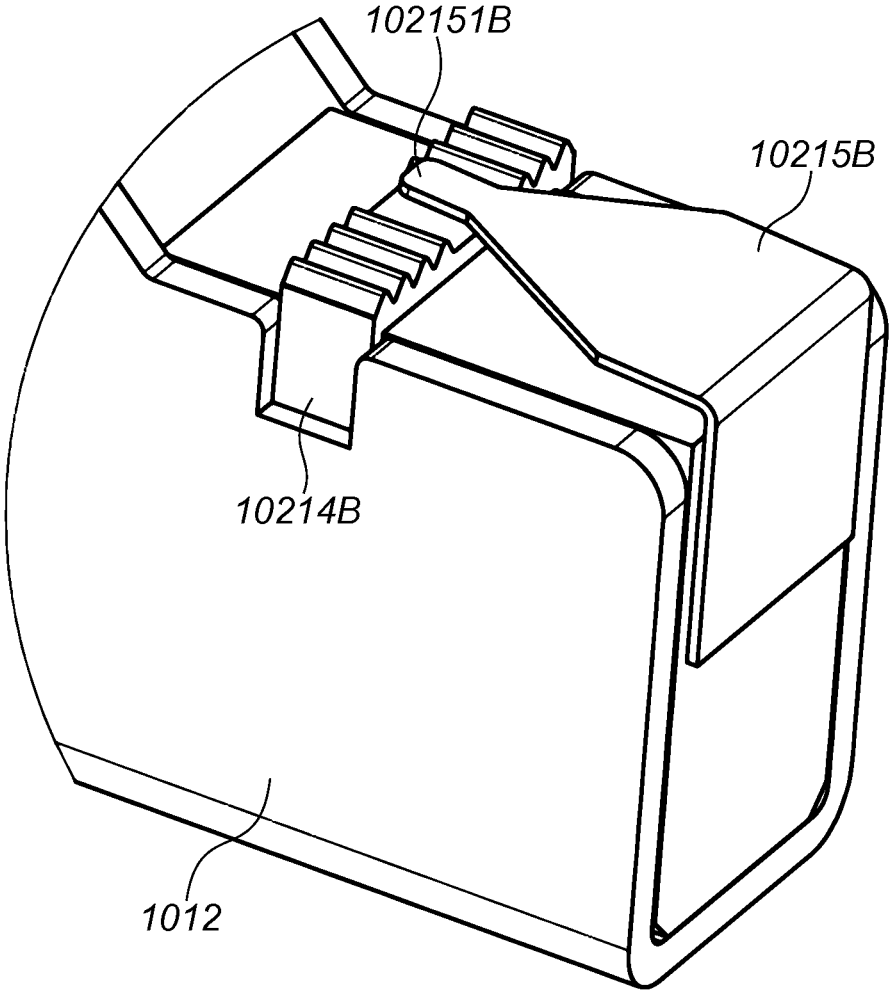
FIG. 17 illustrates a configuration of a staple-free binding unit mounted on a sheet processing apparatus according to a third exemplary embodiment of the present invention.

Next, a third exemplary embodiment of the present invention will be described as an example in which the detachment plate spring is disposed within the regions where the sheets are fastened to one another and at the centers of the upper teeth and the lower teeth. FIG. 17 illustrates a configuration of a staple-free binding unit mounted on a sheet processing apparatus according to the present exemplary embodiment. In FIG. 17, similar or corresponding portions to those illustrated in above-described FIG. 11 are identified by the same reference numerals as those used in FIG. 11.

Figure 18A:
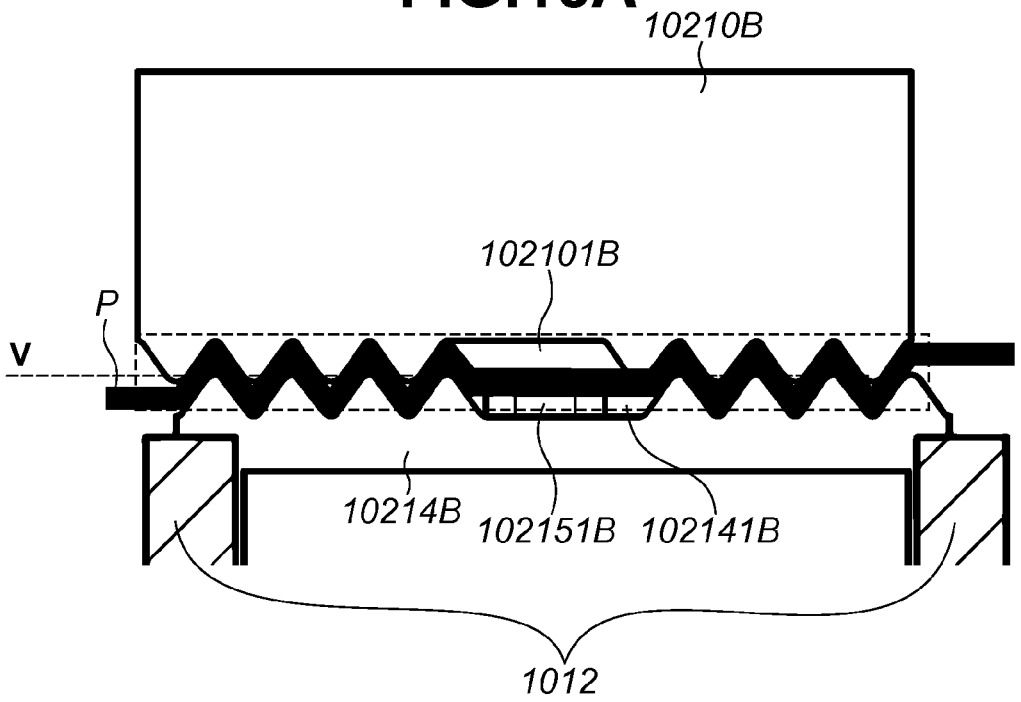
FIGS. 18A and 18B illustrate a state of a detachment plate spring mounted on the staple-free binding unit during the staple-free binding operation.
Figure 18B:
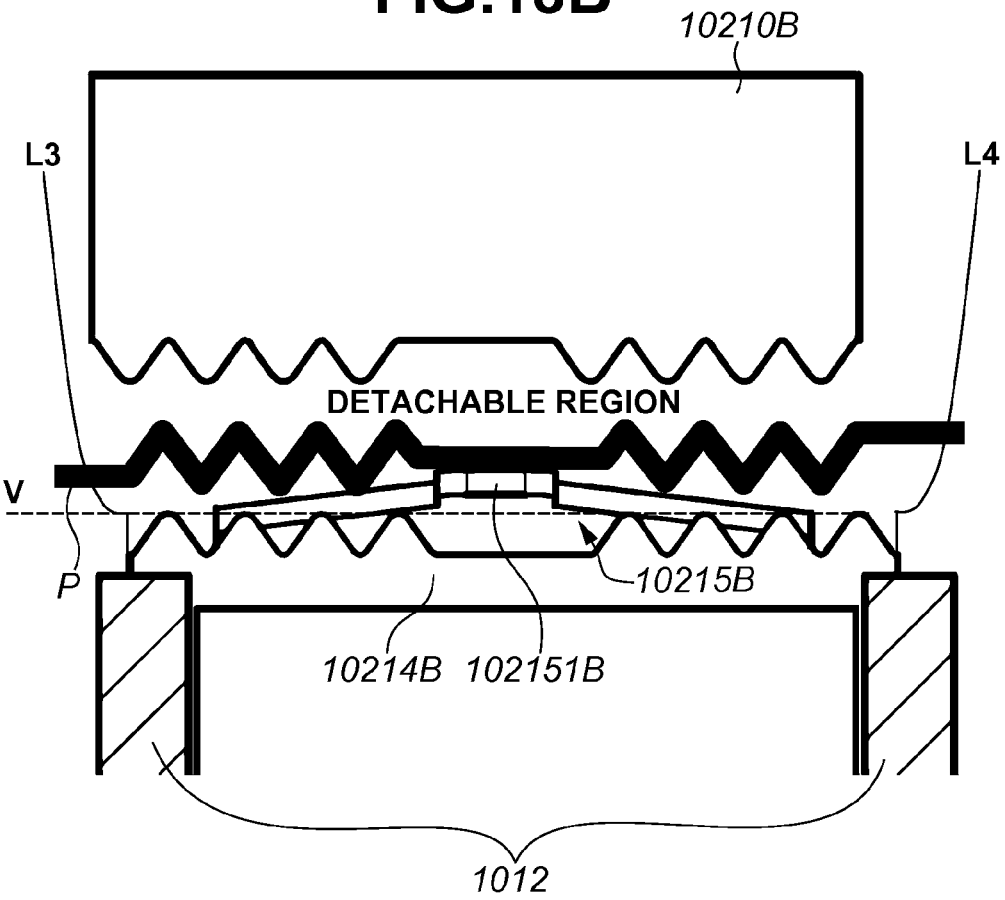

Referring to FIG. 17, the staple-free binding unit according to the present exemplary embodiment includes a detachment plate spring 10215B and lower teeth 10214B. Inverted V shapes are partially removed from the lower teeth 10214B at a center thereof. As illustrated in FIGS. 18A and 18B that will be described below, V shapes are partially removed from upper teeth 10210B at a center thereof. Then, a tip portion 102151B of the detachment plate spring 10215B, which is the elastic member, is disposed between an inverted V shape removed portion 102141B at the center of the lower teeth 10214B and a V shape removed portion 102101B at the center of the upper teeth 10210B, which are tooth missing portions. In other words, the lower teeth 10214B include uneven portions (the deformation surfaces for deforming the sheets) on both sides of the inverted V shape removed portion 102141B, and the tip portion 102151B of the detachment plate spring 10215B is disposed between the two uneven portions of the lower teeth 10214B. The upper teeth 10210B include uneven portions (the deformation surfaces for deforming the sheets) on both sides of the V shape removed portion 102101B, and the tip portion 102151B of the detachment plate spring 10215B is disposed between the two uneven portions of the upper teeth 10210B.

FIG. 18A illustrates the detachment plate spring 10215B with the upper teeth 10210B lowered thereon and the sheet P fastened to the other sheets. At this time, the fiber of the fastened sheet P is placed into a state of sticking to the lower teeth 10214B, and the tip portion 102151B of the detachment plate spring 10215B is lowered while being deflected by being pressed by the upper arm 1029B. At this time, the partial removal of the inverted V shapes and the V shapes from the centers of the lower teeth 10214B and the upper teeth 10210B allows the tip portion 102151B of the detachment plate spring 10215B to enter inside the "detachable region" as illustrated in FIG. 18B.

After that, when the upper arm 1029 is moved upward, the tip portion 102151B of the detachment plate spring 10215B is located on an upper side relative to the top position V of protrusions of the lower teeth 10214B in the z direction as illustrated in FIG. 18B. As a result, an elastic force of the detachment plate spring 10215B is transmitted to the sheet P, and therefore can detach the sheet P stuck to the lower teeth 10214B. In this manner, an excellent detachment performance can be acquired by disposing the detachment plate spring 10215B at a single position at the center, like the present exemplary embodiment, compared to disposing the detachment plate spring 10215B only at a single position at an end.

The above-described exemplary embodiments have been described based on the example in which the staple-free binding unit detaches the sheets by the detachment plate spring. However, the present invention is not limited thereto. For example, the staple-free binding unit may detach the sheets by a pushing member movable vertically and configured to be moved by being driven, instead of the detachment plate spring.

Figure 19:
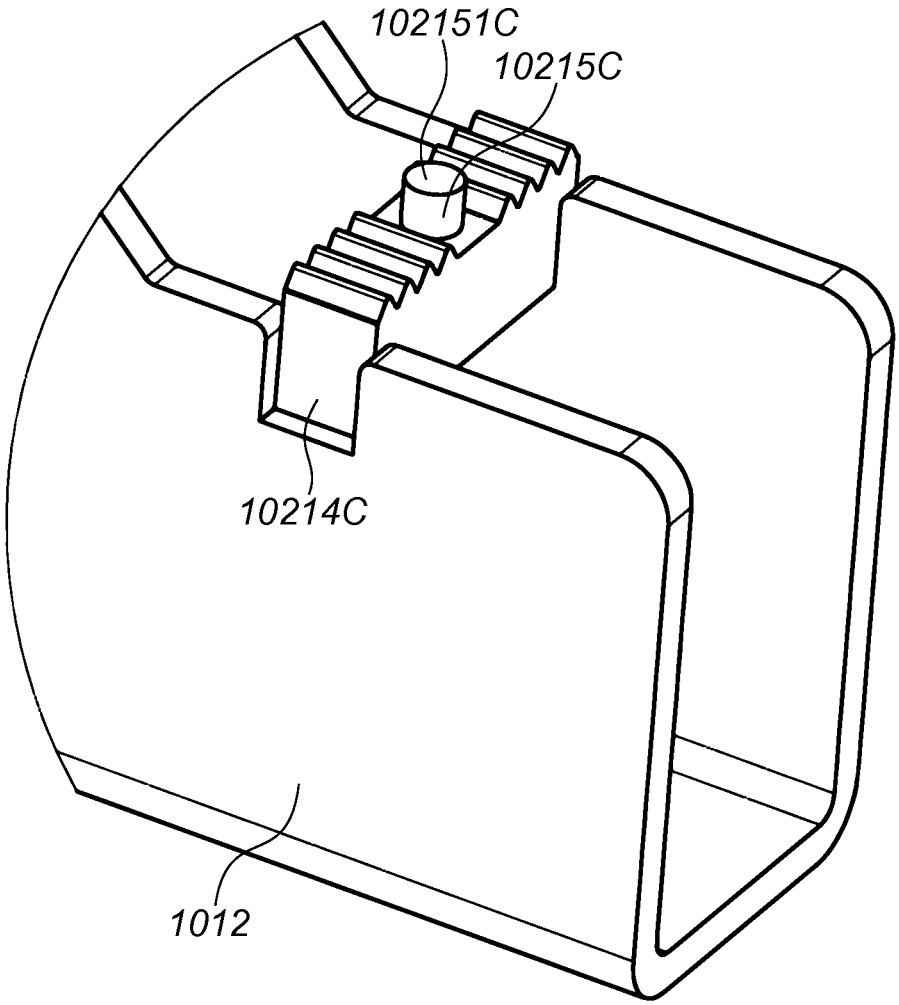
FIG. 19 illustrates a configuration of a staple-free binding unit mounted on a sheet processing apparatus according to a fourth exemplary embodiment of the present invention.

Next, a fourth exemplary embodiment of the present invention will be described as an example in which the staple-free binding unit detaches the sheets by the vertically movable pushing member, instead of the detachment plate spring. FIG. 19 illustrates a configuration of a staple-free binding unit mounted on a sheet processing apparatus according to the present exemplary embodiment. In FIG. 19, similar or corresponding portions to those illustrated in above-described FIG. 11 are identified by the same reference numerals as those used in FIG. 11.

Referring to FIG. 19, the staple-free binding unit according to the present exemplary embodiment includes lower teeth 10214C, and a detachment pin 10215C, which is a pushing member disposed vertically movably at, for example, a center of the lower teeth 10214C. The detachment pin 10215C is disposed within the region where the sheets are fastened to one another by removing inverted V shapes at the center of the lower teeth 10214C. As illustrated in FIG. 20 that will be described below, V shapes are removed at a center of upper teeth 10210C. Then, the detachment pin 10215C is disposed between an inverted V shape removed portion at the center of the lower teeth 10214C and a V shape removed portion at the center of the upper teeth 10210C.

Figure 20A:
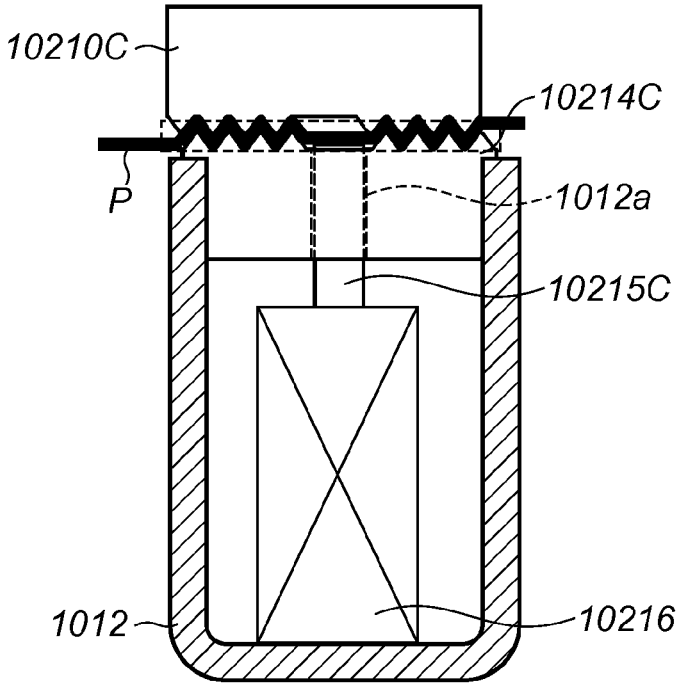
FIGS. 20A and 20B illustrate a state of a detachment pin mounted on the staple-free binding unit during the staple-free binding operation.
Figure 20B:
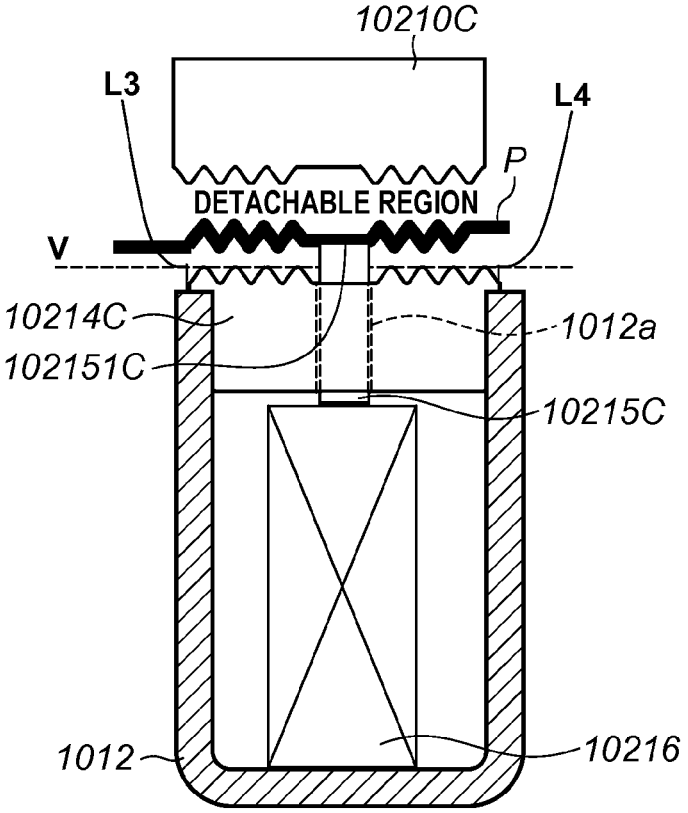

Further, as illustrated in FIGS. 20A and 20B, an opening 1012*a*, through which a tip portion 102151C of the detachment pin 10215C protrudes, is formed at the inverted V shape removed portion of the lower teeth 10214C. The detachment pin 10215C vertically slides through this opening 1012*a*. This detachment pin 10215C is moved vertically by a solenoid 10216 disposed below the detachment pin 10215C. In this manner, in the present exemplary embodiment, the detachment pin 10215C is disposed so as to be able to protrude in a direction for detaching the sheets, and is moved to a retracted position and a position where the detachment pin 10215C protrudes in the direction for detaching the sheets by the solenoid 10216, which is a driving unit configured to move the detachment pin 10215C by driving it.

FIG. 20A illustrates the detachment pin 10215C with the upper teeth 10210C lowered thereon and the sheet P fastened to the other sheets. At this time, the fibers of the fastened sheet P are placed into a state of sticking to the lower teeth 10214C. At this time, the detachment pin 10215C is lowered by the solenoid 10216 to the position where the detachment pin 10215C does not interfere with the upper teeth 10210C being lowered to fasten the sheets to one another.

After that, according to an upward movement of the upper arm 1029, the detachment pin 10215C is raised by the solenoid 10216 so that the tip portion 102151C thereof protrudes upward relative to the top position V of protrusions of the lower teeth 10214C in the z direction as illustrated in FIG. 20B. As a result, the sheet P stuck to the lower teeth 10214C can be detached by the detachment pin 10215C with the use of a pushing force of the solenoid 10216. In the present exemplary embodiment, the detachment pin 10215C is disposed at the center of the lower teeth 10214C, but a plurality of detachment pins may be disposed around the lower teeth 10214C or in a "binding region". In this manner, a similar effect to the above-described first exemplary embodiment can be acquired by configuring the staple-free binding unit so as to detach the sheets with the use of the detachment pin 10215C, like the present exemplary embodiment.

Alternatively, the staple-free binding unit may be configured in such a manner that the detachment pin 10215C is raised by the solenoid 10216 after the upper arm 1029 is moved upward.

Further, in the second to fourth exemplary embodiments, the detachment plate spring 10215A or 10215B, or the detachment pin 10215C is disposed only at the lower teeth. However, the present invention is not limited thereto. If the surface property of the tooth form is similar between the upper teeth and the lower teeth, a similar detachment effect can be acquired by disposing the detachment plate spring 10215A or 10215B, or the detachment pin 10215C at the upper and lower teeth.

Figure 21:
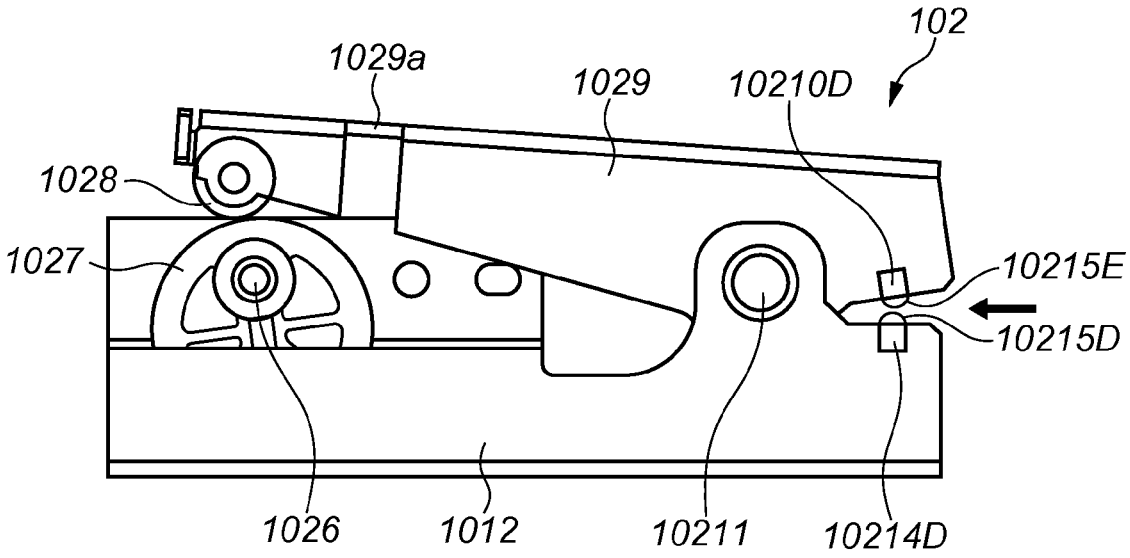
FIG. 21 illustrates a configuration of a staple-free binding unit mounted on a sheet processing apparatus according to a fifth exemplary embodiment of the present invention.

Next, a fifth exemplary embodiment of the present invention will be described as an example in which the staple-free binding unit includes detachment wire springs disposed at the lower teeth and the upper teeth instead of the detachment plate spring, and detaches the sheets with the use of these detachment wire springs. FIG. 21 illustrates a configuration of a staple-free binding unit mounted on a sheet processing apparatus according to the present exemplary embodiment. In FIG. 21, similar or corresponding portions to those illustrated in above-described FIG. 11 are identified by the same reference numerals as those used in FIG. 11.

Figure 22:
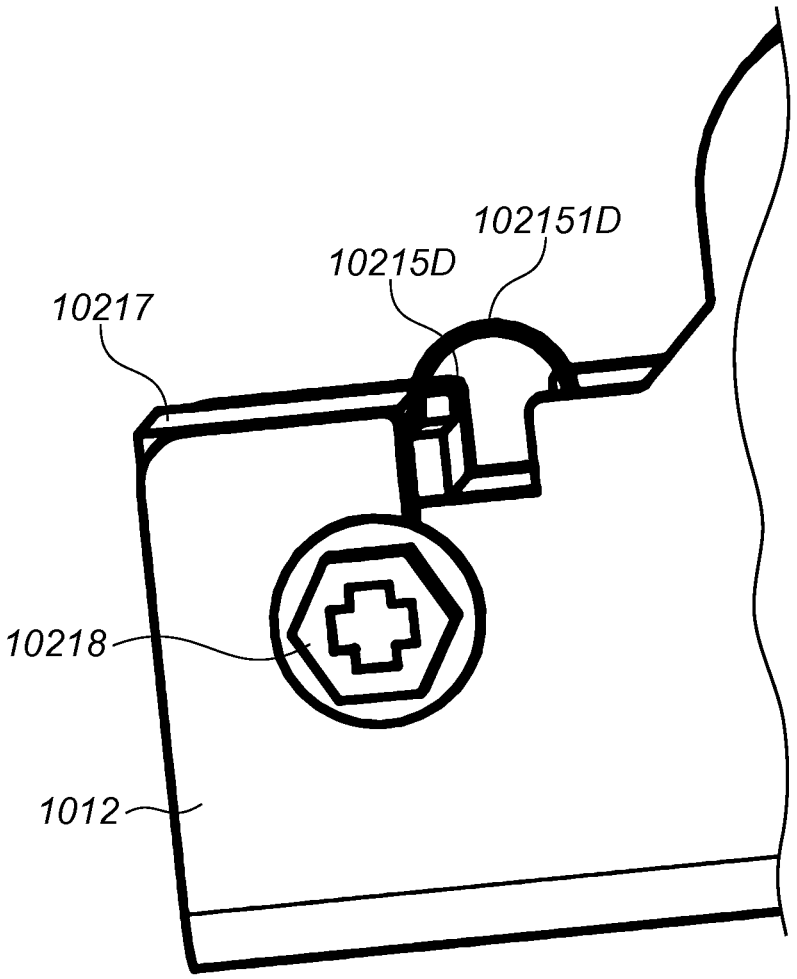
FIG. 22 is an enlarged view illustrating main parts of the staple-free binding unit.

Referring to FIG. 21, the staple-free binding unit according to the present exemplary embodiment includes lower teeth 10214D, and a detachment wire spring 10215D, which is the elastic body disposed at, for example, a center of the lower teeth 10214D and configured to detach the bound sheets by pushing them in a direction away from the lower teeth 10214D. This detachment wire spring 10215D, which is a first detachment unit, is disposed within the region where the sheets are fastened to one another by removing inverted V shapes at the center of the lower teeth 10214D. As illustrated in FIG. 22, the detachment wire spring 10215D is held by a support block 10217, and this support block 10217 is attached to the lower arm 1012 by a fixation screw 10218. Further, as illustrated in FIG. 23A, a detachment wire spring 10215E, which is a second detachment unit configured to detach the bound sheets by pushing them in a direction away from upper teeth 10210D, is also disposed at, for example, a center of the upper teeth 10210D by removing V shapes thereof and using a similar attachment configuration to the lower teeth 10214D.

In the present exemplary embodiment, the lower teeth 10214D and the upper teeth 10210D are formed by similar processing methods, and therefore there is no difference between their surface properties. Then, if there is no difference between the surface properties of the lower teeth 10214D and the upper teeth 10210D, the fibers of the bound sheets are stuck to at least one of the lower teeth 10214D and the upper teeth 10210D.

Figure 23A:
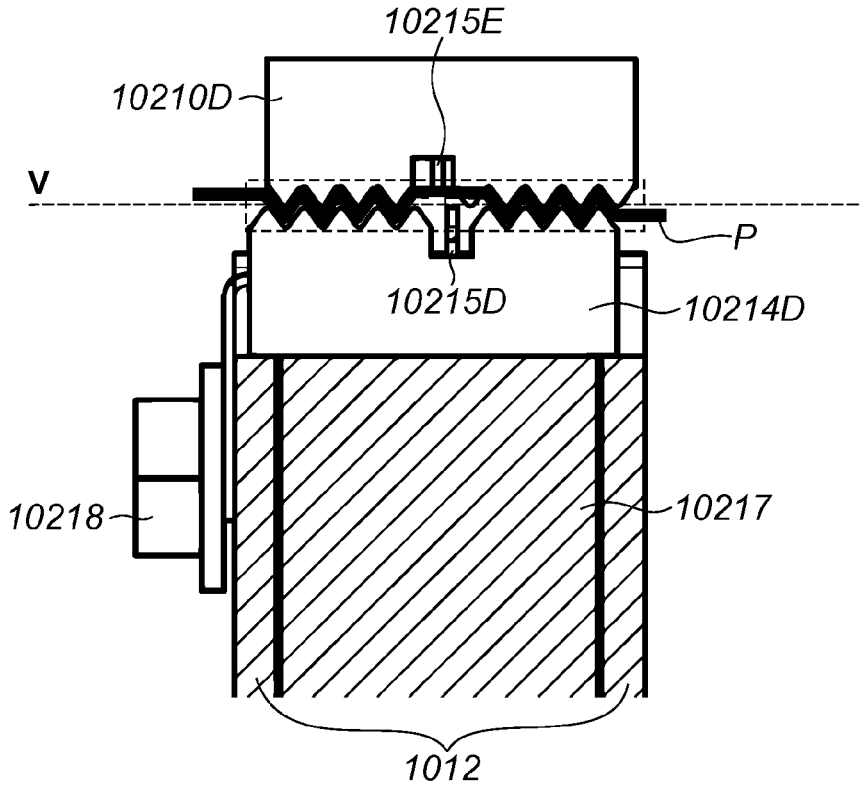
FIGS. 23A and 23B illustrate states of detachment wire springs mounted on the staple-free binding unit during the staple-free binding operation.

In the present exemplary embodiment, the "binding region", where the staple-free binding unit fastens the sheets to one another, corresponds to a region indicated by a broken line in FIG. 23A, and the partial removal of the inverted V shapes and the V shapes allows the detachment wire springs 10215D and 10215E to enter inside the "detachable region". The detachment wire spring 10215D is smaller than the detachment plate spring and the detachment pin, and therefore can reduce an amount of the V shapes and the inverted V shapes of the upper teeth 10210D and the lower teeth 10214D required to be removed. As a result, even with the same "binding region", the present exemplary embodiment can increase the inverted V shapes and the V shapes within the region, thereby improving the fastening force.

Figure 23B:
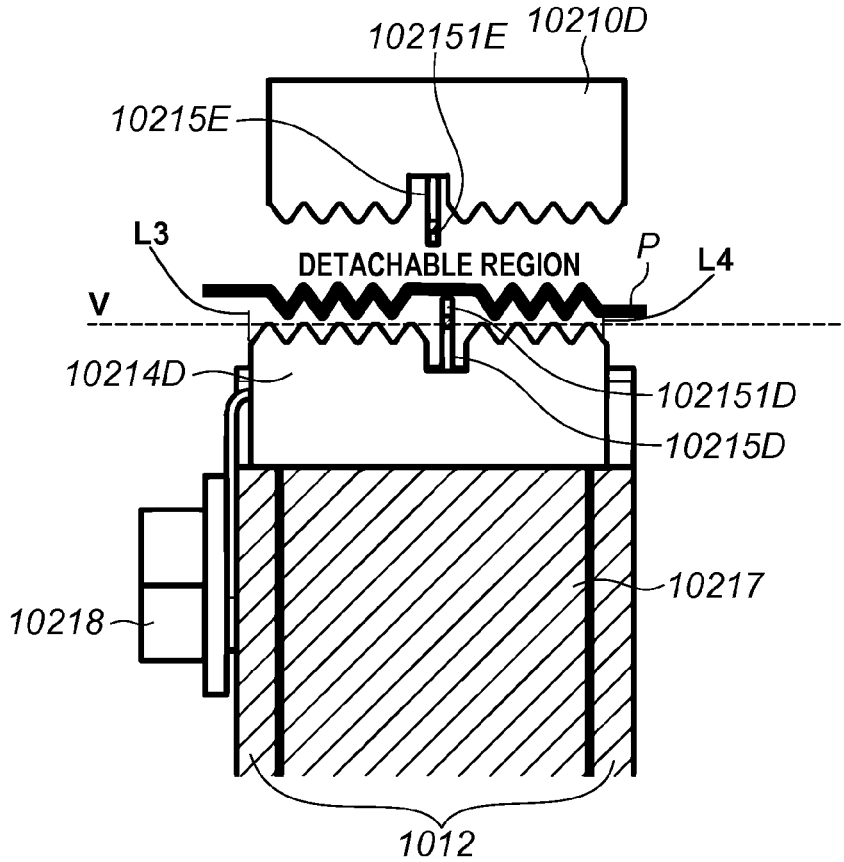

When the binding is not performed, a tip portion 102151D of the detachment wire spring 10215D is located on an upper side relative to the top position V of protrusions of the lower teeth 10214D in the z direction as illustrated in FIG. 23B. Further, a tip portion 102151E of the detachment wire spring 10215E is located on the upper side relative to at least the top position V of the protrusions of the lower teeth 10214D in the z direction.

FIG. 23A illustrates the detachment wire springs 10215D and 10215E with the upper teeth 10210D lowered thereon and the sheet P fastened to the other sheets. At this time, the fibers of the fastened sheet P is stuck to at least one of the lower teeth 10214D and the upper teeth 10210D. Further, the tip portion 102151D of the detachment wire spring 10215D and the tip portion 102151E of the detachment wire spring 10215E are placed from the state illustrated in FIG. 23B into a deflected state by being pressed via the sheet P.

After that, when the upper arm 1029 is moved upward, an elastic force of the tip portion 102151D of the detachment wire spring 10215D is transmitted to the sheet P, thereby detaching the sheet P from the lower teeth 10214D as illustrated in FIG. 23B. Further, an elastic force of the tip portion 102151E of the detachment wire spring 10215E is transmitted to the sheet P, thereby detaching the sheet P from the upper teeth 10210D. In this manner, a similar effect to the above-described first exemplary embodiment can be acquired, and a reduction in the size of the apparatus can be realized by configuring the staple-free binding unit so as to detach the sheets with the use of the detachment wire springs 10215D and 10215E, like the present exemplary embodiment.

In the present exemplary embodiment, the detachment wire spring 10215D and the detachment wire spring 10215E are disposed at the centers of the lower teeth 10214D and the upper teeth 10210D, respectively, but the positions thereof are not limited to this example. Further, the pushing force for detaching the sheets may be increased by disposing a plurality of detachment wire springs in an arranged manner.

Further, the upper teeth 10210D and the lower teeth 10214D may be formed so as to have different surface properties from each other in a similar manner to the above-described first to fourth exemplary embodiments, and the detachment wire spring may be disposed only at one of the tooth forms that has a coarser surface. Further, if the surface property of the tooth form is similar between the upper teeth 10210D and the lower teeth 10214D, like the present exemplary embodiment, a similar detachment effect can be acquired by disposing the detachment plate spring 10215, 10215A, or 10215B, or the detachment pin 10215C at the upper and the lower teeth.

Figure 24:
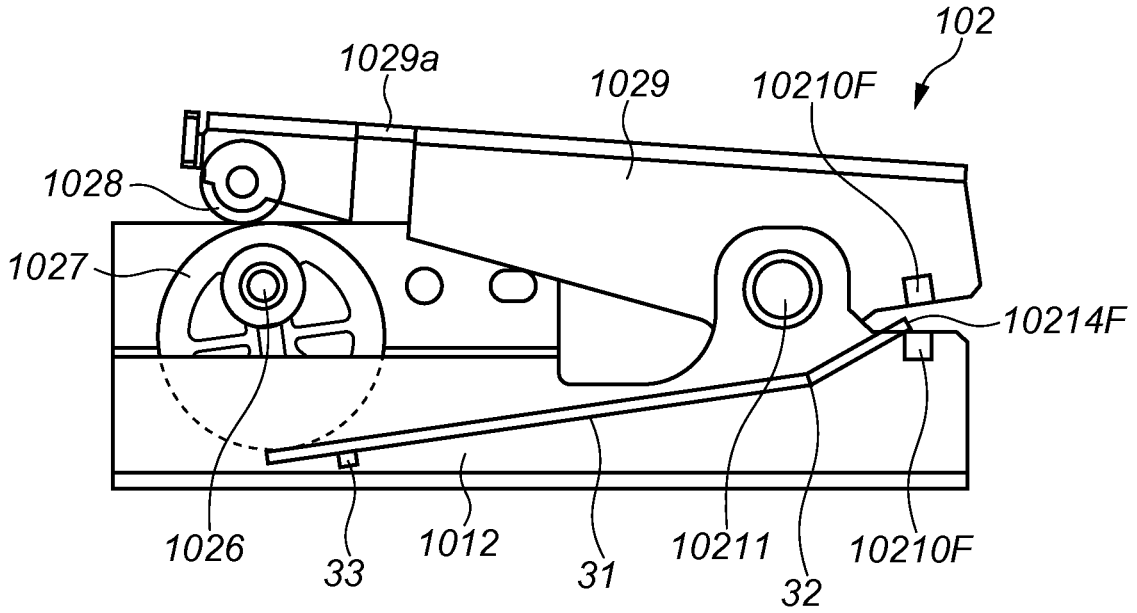
FIG. 24 illustrates another exemplary embodiment of the sheet binding apparatus.

As illustrated in FIG. 24, the staple-free binding unit may be configured to detach the sheet bundle from the lower teeth with the use of a lever 31 configured to be raised and lowered according to a movement of the cam 1027. Referring to FIG. 24, the lever 31 is disposed rotatably about an axis 32, and is biased into abutment with the bottom of the cam 1027 by a spring 33. A tip portion 10214F of the lever 31 can protrude upward relative to tips of lower teeth 10210F. When the cam 1027 is located at a position where the cam 1027 causes the lower teeth 10210F and upper teeth 10210F to be engaged with each other, the tip portion 10214F of the lever 31 is retracted to a lower position relative to the teeth of the lower teeth 10210F. A swinging movement of the lever 31 according to a rotation of the cam 1027 causes the tip portion 10214F of the lever 31 to protrude beyond the lower teeth 10210F. The lever 31 is disposed in such a manner that the tip portion 10214F of the lever 31 is located within the detachable region when protruding. In other words, when the upper teeth 10210F and the lower teeth 10210F are separated from each other by the rotation of the cam 1027, the tip portion 10214F detaches the sheet bundle stuck to the lower teeth 10210F. In the present exemplary embodiment, the staple-free binding motor M257 and the cam 107, which constitute the moving unit configured to move the upper teeth 10210F, also corresponds to the driving unit configured to drive the lever 31 as the detachment unit.

All of the above-described exemplary embodiments have been described based on the example in which the lower teeth are fixed and only the upper teeth are moved by the moving unit 102A. However, the respective exemplary embodiments may be configured in such a manner that the upper teeth are fixed and only the lower teeth are moved by the moving unit. Alternatively, the respective exemplary embodiments may be configured in such a manner that both the upper teeth and the lower teeth are movable and the moving unit moves them into and out of contact with each other.

While the present invention has been described with reference to exemplary embodiments, it is to be understood that the invention is not limited to the disclosed exemplary embodiments.

This application claims the benefit of Japanese Patent Application No. 2013-115584 filed May 31, 2013, which is hereby incorporated by reference herein in its entirety.

What is claimed is:

1. An apparatus for processing a sheet bundle including a sheet conveyed from an image forming unit, the apparatus comprising:

a binding unit including:

a first portion having a first protrusion and a second protrusion, and a second portion having a first concave and a second concave, wherein the binding unit is configured to bind the sheet bundle by the first protrusion nipping the sheet bundle with the first concave and the second protrusion nipping the sheet bundle with the second concave; and a detachment unit positioned between the first protrusion and the second protrusion and configured to urge the bound sheet bundle away from the first portion such that the bound sheet bundle is detached from the first protrusion.

2. The apparatus according to claim 1, wherein the detachment unit is arranged to detach the bound sheet bundle from the first and second protrusions as the first portion and the second portion move apart to release the sheet bundle from nipping.

3. The apparatus according to claim 1, wherein the detachment unit is moveable to protrude toward the second portion beyond a tip of the first and second protrusions in the thickness direction of the sheet bundle when the first and second protrusions and the first and second concaves are separated from each other.

4. The apparatus according to claim 1, wherein the detachment unit includes an elastic member elastically deformable by being pressed by the sheet bundle before the sheet bundle is bound, and wherein the detachment unit is arranged to detach the sheet bundle from the first portion with aid of a restoring force of the elastic member when the first portion and the second portion are separated from each other.

5. The apparatus according to claim 4, wherein the elastic member is a plate spring.

6. The apparatus according to claim 4, wherein the elastic member is a wire spring.

7. The apparatus according to claim 1, wherein the first and second protrusions of the first portion have a coarseness that is greater than a coarseness of the first and second concaves of the second portion.

8. The apparatus according to claim 1, wherein the detachment unit additionally is disposed outside the first and second protrusions of the first portion.

9. The apparatus according to claim 8, wherein the detachment unit includes a plurality of contact portions configured to contact the sheet bundle, and wherein the first and second protrusions are arranged between the plurality of contact portions.

10. The apparatus according to claim 1, wherein the first portion includes a plurality of teeth that forms the first and second protrusions and is configured to deform the sheet bundle in the thickness direction of the sheet bundle, and wherein the detachment unit is disposed at a location on the first portion distinct from the plurality of teeth.

11. The apparatus according to claim 1, further comprising a driving unit configured to move the detachment unit by driving the detachment unit from a position where the first portion and the second portion nip the sheet bundle there between to a position where the first portion and second portion are separated and the detachment unit protrudes toward the second portion.

12. The apparatus according to claim 1, further comprising a moving unit configured to move one of the first portion and the second portion between a position where the first portion and the second portion nip the sheet bundle there between and a release position where the first portion and the second portion are separated from each other to release the sheet bundle from nipping.

13. An image forming apparatus, comprising:

the apparatus according to claim 1; and an image forming unit configured to form an image on a sheet of the sheet bundle.

14. The image forming apparatus according to claim 13 further comprising a discharging unit configured to discharged, onto the binding unit, the sheet on which the image has been formed by the image forming unit.

15. The apparatus according to claim 1, further comprising a second detachment unit configured to urge the sheet bundle toward the first portion such that, in a case where the bound sheet bundle is attached to the first and second concaves, the bound sheet bundle detaches from the first and second concaves.

16. The apparatus according to claim 1, wherein a contact portion of the detachment unit, the contact portion being in contact with the surface of the bound sheet bundle, pushes the bound sheet bundle away from the first and second protrusions such that the bound sheet bundle is detached from the first and second protrusions.

17. The apparatus according to claim 1, wherein the detachment unit urges the bound sheet bundle away from the first portion based on relative movement between the detachment unit and the first and second protrusions.

18. The apparatus according to claim 17, wherein the first and second protrusions are stationary and the detachment unit is a pushing member that moves relative to the first and second protrusions.

19. The apparatus according to claim 17, wherein the first and second concaves are stationary and the first and second protrusions moves relative to the stationary first and second concaves.

20. The apparatus according to claim 1, wherein the detachment unit either is a detachment wire spring disposed within the first portion or includes a detachment pin disposed within the first portion and a solenoid configured to move the detachment pin.

21. The apparatus according to claim 1, wherein the detachment unit pushes the bound sheet bundle away from the first portion such that the bound sheet bundle is detached from the first and second protrusions when the detachment unit is in contact with the surface of the bound sheet bundle in the thickness direction of the bound sheet bundle.

22. The apparatus according to claim 1, wherein the first and second protrusions includes a plurality of protrusions and indentations, and the first and second concaves includes a plurality of protrusions and indentations.

23. The apparatus according to claim 1, wherein the first and second protrusions includes a plurality of concaves and convexes, and the first and second concaves includes a plurality of concaves and convexes.

24. The apparatus according to claim 1, wherein the detachment unit is positioned on the first portion.

25. An apparatus for processing a sheet bundle, the apparatus comprising:

a binding unit including a first portion and a second portion, and configured to nip the sheet bundle between the first portion and the second portion at a nip portion to deform the sheet bundle in a thickness direction of the sheet bundle to bind the sheet bundle;

a first detachment unit configured to urge the bound sheet bundle toward the second portion such that, in a case where the bound sheet bundle is attached to the first portion, the bound sheet bundle is detached from the first portion; and a second detachment unit configured to urge the sheet bundle toward the first portion such that, in a case where the bound sheet bundle is attached to the second portion, the bound sheet bundle is detached from the second portion, wherein at least one of the first detachment unit and the second detachment unit is positioned within the nip portion.

26. The apparatus according to claim 25, wherein each of the first portion and the second portion includes an uneven portion configured to deform the sheet bundle in the thickness direction of the sheet bundle by contacting the sheet bundle, and wherein the first detachment unit is moveable to protrude beyond a tip of the uneven portion of the first portion in the thickness direction of the sheet bundle when the first portion and the second portion are separated from each other.

27. The apparatus according to claim 25, wherein the first detachment unit includes a plurality of contact portions contacting the sheet to detach a sheet from one of the first portion and the second portion, wherein each of the first portion and the second portion includes a deformation surface configured to deform the sheet bundle in the thickness direction of the sheet bundle by contacting the sheet bundle, and wherein the deformation surface of the first portion is arranged between the plurality of contact portions.

28. The apparatus according to claim 25, wherein each of the first portion and the second portion includes a plurality of deformation surfaces configured to deform the sheet bundle in the thickness direction of the sheet bundle by contacting the sheet bundle, and wherein the first detachment unit is disposed between the plurality of deformation surfaces.

29. The apparatus according to claim 25, wherein the first portion includes a first protrusion and second protrusion, wherein the second portion includes a first concave and a second concave facing the first and second protrusions, and wherein the binding unit binds the sheet bundle by nipping the sheet bundle with the first and second protrusions and the first and second concaves.

30. The apparatus according to claim 25, further comprising:

an image forming unit configured to form an image on a sheet of the sheet bundle; and a discharging unit configured to discharged, onto the binding unit, the sheet on which the image has been formed by the image forming unit.

31. The apparatus according to claim 25, wherein the first portion is offset from the second portion along a surface of the sheet bundle.

32. The apparatus according to claim 25, wherein the first and second protrusions includes a plurality of protrusions and indentations, and the first and second concaves includes a plurality of protrusions and indentations.

33. An apparatus for processing a sheet bundle including a sheet conveyed from an image forming unit, the apparatus comprising:

a binding unit including:

a first portion having a plurality of protrusions, and a second portion having a plurality of concaves, wherein the binding unit is configured to bind the sheet bundle by the plurality of protrusions nipping the sheet bundle with the plurality of concaves; and a detachment unit, wherein the detachment unit includes first, second and third edges, as viewed in a thickness direction of the bound sheet bundle, that surround and oppose the plurality of protrusions, wherein the second and third edges connect with and are orthogonal to the first edge, and wherein the detachment unit is configured to urge the bound sheet bundle away from the first portion such that the bound sheet bundle is detached from at least one of the plurality of protrusions.

34. The apparatus according to claim 33, wherein the first edge faces a side of the plurality of protrusions and a length of the first edge is longer than a length of the side of the plurality of protrusions.

* * * * *